US007367653B2

(12) United States Patent
Yaron

(10) Patent No.: US 7,367,653 B2
(45) Date of Patent: May 6, 2008

(54) LASER INK JET PRINTER

(76) Inventor: Ran Yaron, 533 22nd St., Boulder, CO (US) 80302

( * ) Notice: Subject to any disclaimer, the term of this patent is extended or adjusted under 35 U.S.C. 154(b) by 0 days.

(21) Appl. No.: 11/341,876

(22) Filed: Jan. 27, 2006

(65) Prior Publication Data

US 2006/0187260 A1 Aug. 24, 2006

(51) Int. Cl.
*B41J 2/04* (2006.01)

(52) U.S. Cl. ..... 347/54

(58) Field of Classification Search ..... 347/54, 347/20, 47, 53, 56–61, 67
See application file for complete search history.

(56) References Cited

U.S. PATENT DOCUMENTS

| | | | | |
|---|---|---|---|---|
| 3,832,579 | A | 8/1974 | Arndt | |
| 4,336,544 | A | 6/1982 | Donald et al. | |
| 4,351,617 | A | 9/1982 | Landa | |
| 4,480,259 | A | 10/1984 | Kruger et al. | |
| 4,490,728 | A | 12/1984 | Vaught et al. | |
| 4,581,618 | A * | 4/1986 | Watanabe et al. | 347/104 |
| 4,723,129 | A | 2/1988 | Endo et al. | |
| 4,847,639 | A | 7/1989 | Sugata et al. | |
| 5,021,808 | A | 6/1991 | Kohyama | |
| 5,219,785 | A | 6/1993 | Welch et al. | |
| 5,255,016 | A | 10/1993 | Usui et al. | |
| 5,455,606 | A * | 10/1995 | Keeling et al. | 347/7 |
| 6,343,852 | B1 * | 2/2002 | Yoon | 347/54 |
| 6,352,535 | B1 | 3/2002 | Lewis et al. | |

(Continued)

FOREIGN PATENT DOCUMENTS

| | | |
|---|---|---|
| JP | 405162315 A | 6/1993 |
| JP | 06-106726 | 4/1994 |

OTHER PUBLICATIONS

Daniel Palanker et al., *Electrical alternative to pulsed fiber-delivered lasers in microsurgery*, J. App. Phys. vol. 81 (11) Jun. 1, 1997, 1997 American Institute of Physics, pp. 7673-7680.

(Continued)

*Primary Examiner*—Julian D. Huffman
(74) *Attorney, Agent, or Firm*—Knobbe, Martens, Olson & Bear LLP

(57) ABSTRACT

An ink ejecting apparatus that rapidly heats a small volume of ink using radiative heating from pulsating laser light radiation (as opposed to surface conductive heating from a thin film electrical resistive heater). The laser light travels through a bubble that has been formed by a previous pulse and is absorbed by the ink (specifically designed to absorb the laser light) in the first few microns of the ink free surface. By radiatively heating the ink at a heating rate above its critical heating limit (for an example, for water at atmospheric pressure, that limit is about 0.25 MW/g), at least substantially, if not all, of the heated portion of the ink is brought to its superheat limit so as to boil instantaneously (i.e., explosively). This heating technique keeps the bubble from completely collapsing between excitations. The result is a bubble oscillating at high frequencies. This new type of bubble formation enables ink jet printers to run at resonance and at very high speeds. In addition, non-water based inks can be reliably used because the ink is no longer heated by conduction.

28 Claims, 20 Drawing Sheets

U.S. PATENT DOCUMENTS

| | | | |
|---|---|---|---|
| 6,402,304 | B1 | 6/2002 | Qiu et al. |
| 6,457,815 | B1 | 10/2002 | Miller et al. |
| 6,464,333 | B1 | 10/2002 | Scheffelin et al. |
| 6,474,783 | B1 | 11/2002 | Pilossof et al. |
| 6,481,817 | B1 | 11/2002 | Torgerson et al. |
| 6,854,829 | B2 | 2/2005 | Te |

OTHER PUBLICATIONS

J. Stephen Aden et al., *The Third-Generation HP Thermal InkJet Printhead*, Feb. 1994 Hewlett-Packard Journal, pp. 41-45.

Greg Swift, *Thermoacoustics: A Unifying Perspective for Some Engines and Refrigerators*, Fifth Draft, May 29, 2001, Los Alamos National Laboratory, LA-UR 99-895, pp. 81-116.

* cited by examiner

LASER INK JET PRINTER

RELATED APPLICATION

The present application is based upon and claims priority under 35 U.S.C. § 119(e) to U.S. Provisional Application No. 60/355,947, filed Feb. 11, 2002, entitled LASER INK JET PRINTER, and U.S. application Ser. No. 10/365,722, filed Feb. 11, 2003 now U.S. Pat. No. 7,025,442 which is hereby incorporated by reference.

BACKGROUND OF THE INVENTION

1. Field of the Invention

The disclosure herein relates generally to printing technology, and more specifically to an apparatus and method for selectively ejecting ink droplets in response to pulses of electromagnetic energy.

2. Description of the Related Art

Ink-on-demand printing systems provide the ability to print on a variety of media under computer control. In commercially available ink-on-demand printing systems, two primary approaches are used. In one approach, thermal heaters are used to eject ink droplets from an orifice by the explosive formation of a vapor bubble within the ink supply. Typically, the heating of the ink is performed by resistive heating, e.g., by applying an electrical pulse to a resistor in contact with the ink supply. Such systems are described more fully in U.S. Pat. No. 4,490,728 issued to Vaught et al. and in U.S. Pat. No. 4,723,129 issued to Endo et al., both of which are incorporated in their entirety by reference herein. In addition, U.S. Pat. No. 4,351,617 issued to Landa describes a ballistic impact printer which paved the way for such thermal ink-jet systems.

An alternative approach utilizes mechanical displacements of the ink by employing piezoelectric crystals to propel ink from an orifice of a tube of narrow cross-section. Such systems are described more fully in various U.S. patents assigned to Epson Corp., including U.S. Pat. No. 6,402,304 issued to Qiu et al. and U.S. Pat. No. 5,255,016 issued to Usui et al., both of which are incorporated in their entirety by reference.

Despite the fact that both of these approaches have been known for many years, the technology of ink-on-demand ink-jet printing has yet to resolve the fundamental problems associated with these approaches. For example, for thermal systems, a 0.1 millimeter bubble expands in about 1 microsecond, collapses in about 10 microseconds, and the meniscus relaxes in about 100 microseconds after 4 or 5 oscillations (the meniscus serves as a pump to draw new ink into the nozzle). Thus, the bubble collapse time and the meniscus limit the rate of droplet ejection to approximately 4 kHz. In contrast, piezoelectric resonators, which are not sensitive to the nozzle meniscus, can operate at about 75 kHz (limited by the volumetric speed, that is, the change of volume per unit time, of the piezoelectric resonator). However, the relative large size of piezoelectric systems (approximately 1000 times the droplet size) requires correspondingly large separation between the nozzles of these systems. For example, Epson piezoelectric systems have about 20 nozzles per head, as compared to the 300 nozzles per head of thermal systems. Such prior systems thus sacrifice resolution for speed or speed for resolution.

SUMMARY OF THE INVENTION

An aspect of the present invention involves an ink ejecting apparatus that comprises an ink cell containing ink and a nozzle adapted to eject ink and communicating with the ink cell. The ink ejecting apparatus further includes a source of laser light that is optically coupled to the ink within the ink cell. In a preferred embodiment, the source of laser light includes one or more laser diodes, which can be disposed near the ink cells or can be positioned remotely and optically coupled to the ink cells via optical fibers. Light energy from the laser diode(s) rapidly heats a small volume of ink using radiative heating from pulsating laser light radiation (as opposed to surface conductive heating from a thin film electrical resistive heater).

In a preferred mode, the laser light preferably travels through a bubble that has been formed by a previous pulse and is absorbed by the ink. By radiatively heating the ink at a heating rate above its critical heating limit, at least substantially if not all of the heated portion of the ink is brought to its superheat limit so as to boil instantaneously (i.e., explosively). This heating technique keeps the bubble from completely collapsing between excitations. The result is a bubble oscillating at high frequencies. This new type of bubble formation enables ink jet printers to run at resonance and at very high speeds. In addition, non-water based inks can be reliably used because the ink is no longer heated by conduction.

In accordance with another aspect of the present invention, an ink ejecting apparatus comprises a miniature opto-mechanical engine that is run at resonance so as to improve the overall efficiency of the printer and to overcome some of the disadvantages of conventional printers, such as the large size of piezoelectric printers and the speed of thermal printers. While prior thermal ink jet printers typically have overall energy efficiencies of less than 1% (i.e., the kinetic energy of the ejected ink droplets is less than 1% of the thermal driving energy), embodiments described herein have overall efficiencies which are significantly higher by running at resonance. The power of individual energy pulses to excite the system from rest to eject a single ink droplet is typically greater than the energy pulse power of a train of pulses. Thus, by producing trains of ink droplets by selectively timing the pulse excitations, embodiments described herein can produce droplets faster than many prior printers.

In accordance with another aspect of the present invention, an ink ejecting apparatus is provided that comprises a nozzle adapted to eject ink. The ink ejecting apparatus further comprises an engine including a liquid mass, and a source of electromagnetic energy. The source of electromagnetic energy energizes the liquid mass by exposing a portion of the liquid mass to electromagnetic energy. The engine further includes a gas spring disposed within a propagation path of the electromagnetic energy. The engine is arranged such that movement of the liquid mass ejects ink through the nozzle.

In accordance with an additional aspect of the present invention, an ink ejecting apparatus comprises an ink cell containing ink and a nozzle adapted to eject ink and communicating with the ink cell. The ink ejecting apparatus further comprises an engine including a chamber having a chamber wall. The engine further includes a liquid piston disposed within the chamber. The liquid piston has a first surface not in contact with the chamber wall. The engine further includes an energy source positioned to directly heat the first surface of the liquid piston. The engine further includes a gas spring positioned within the chamber adjacent to the first surface of the liquid piston. The engine further includes a spring mechanism positioned to exert pressure on a second surface of the liquid piston. The engine is arranged such that movement of the liquid piston is at least partially transmitted to the ink within the ink cell so as to selectively eject ink through the nozzle.

In accordance with another aspect of the present invention, a method of printing comprises providing an ink cell containing ink and a nozzle adapted to eject ink from the ink cell. The method further comprises coupling an engine to the ink cell. The engine includes a chamber and an oscillatory liquid mass within the chamber. The engine is arranged such that oscillatory movement of the liquid mass is at least partially transmitted to the ink within the ink cell so as to selectively eject ink through the nozzle. The method further comprises ejecting ink through the nozzle by selectively applying electromagnetic energy to the engine.

An additional aspect of the present invention involves a printing method in which an ink cell is provided. The ink cell contains ink and a nozzle is coupled to the ink cell. A portion of the ink is heated by a source of laser energy to convert a portion of the ink within the ink cell to a gas phase and propelling at least a portion of the reminder of the ink within the ink cell to eject ink through the nozzle. At least a portion of the gas phase portion is reconverted back to a liquid phase portion. The steps of converting and reconverting the ink between gas and liquid phases are sequentially repeated.

These and other aspects of the present invention will become readily apparent to those skilled in the art from the following detailed description of the preferred embodiments, which refers to the attached figures. The invention is not limited, however, to the particular embodiments that are disclosed.

BRIEF DESCRIPTION OF THE DRAWINGS

Embodiments described herein will be readily understood by the following detailed description in conjunction with the accompanying drawings, wherein like reference numerals designate like structural elements.

DETAILED DESCRIPTION OF PREFERRED EMBODIMENTS

Figure 1:
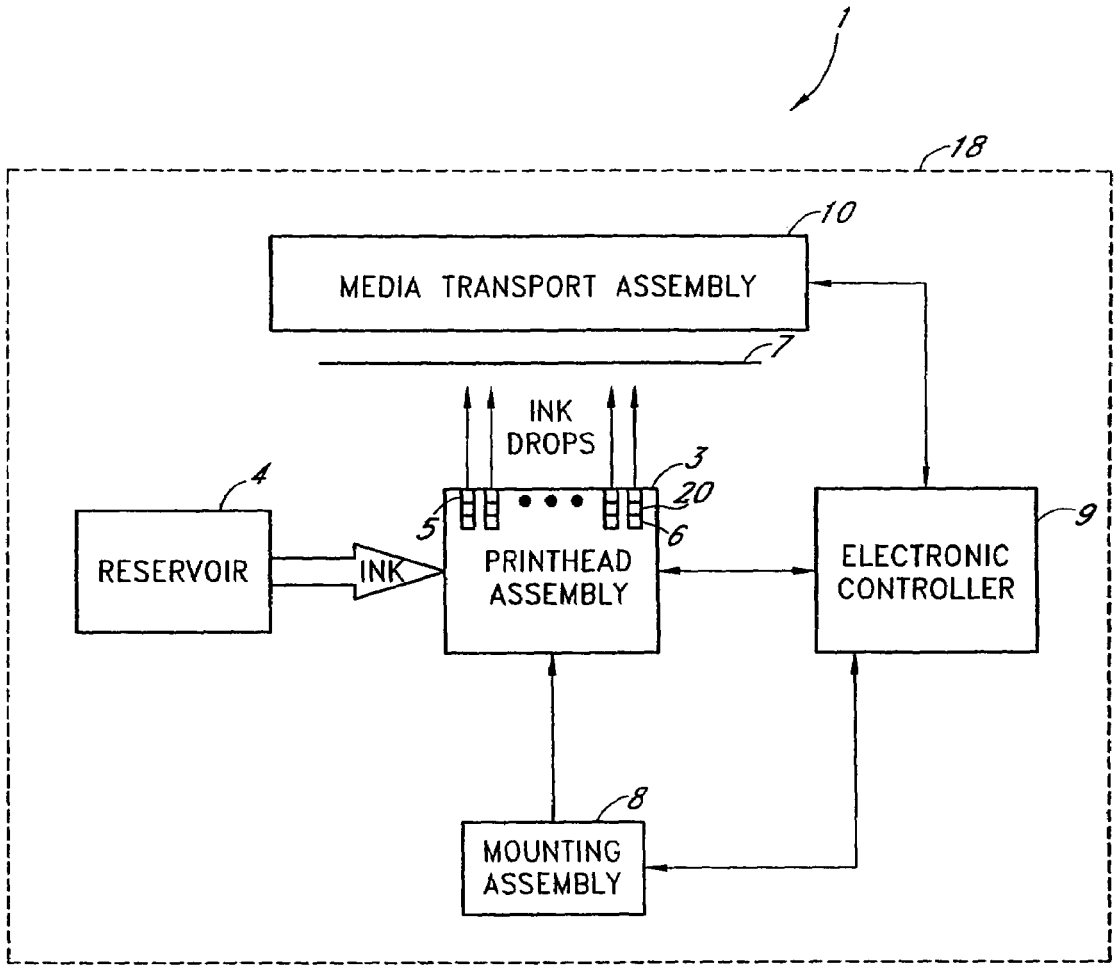
FIG. 1 is a block diagram of an embodiment of an ink ejecting apparatus comprising an ink cartridge which includes a printhead assembly and an ink reservoir.

FIG. 1 is a block diagram of a preferred embodiment of an inkjet printing system 1 that includes an ink ejecting apparatus 18. The apparatus 18 comprises a plurality of ink cells 20, each of which communicates with a dedicated nozzle 5. Each nozzle 5 ejects ink in response to rapid evaporation (explosive boiling), which occurs either in the ink within the ink cell 20 or in a fluid that is in fluidic communication with the ink such that displacement of the fluid due to the rapid evaporation is transmitted to the ink. Displacement of the ink in the ink cell 20 causes ink to eject through the nozzle 5 onto a print medium 7.

The explosive boiling occurs by instantly heating (i.e., superheating) a small portion of the volume of the ink or liquid with sufficient energy density. In contrast, prior thermal inkjet printers use surface conductive heating by thin film electrical resistive heaters. The superheat limit of a liquid is about 90% of the liquid's critical temperature (e.g., for water, the measured superheat limit is 575° K and the critical temperature is 647° K). One suitable source of electromagnetic energy to achieve superheating of the liquid (e.g., ink), as described in more detail below, is one or more laser diodes 6. In a preferred mode, each ink cell 20 is paired with a laser diode 6. The laser diode 6 preferably is optically coupled to the ink cell 20 by one or more optical elements (e.g., optical fiber or lenses), as described below in greater detail. The laser diode 6 also is preferably modulated during its operation to controllably produce energy pulses at a repetition rate causing resonant oscillations of the ink/fluid within the ink cell 20 to improve the printing system's efficiency and speed.

As seen in FIG. 1, an ink reservoir 4 communicates with the ink ejecting apparatus 18. At least a portion of the ink ejecting apparatus 18 and the ink reservoir 4 can be integrated together or can be separate components of the system. The ink ejecting apparatus 18 also can be integrated into a printhead assembly 3 of the inkjet printing system 1 (as seen in FIGS. 2 and 3) or the components of the ink ejecting apparatus 18 can be distributed at various separate locations within the inkjet printing system 1 (as seen in FIGS. 4A and 4B). In this latter mode, a plurality of optical fibers are coupled to one or more laser diodes that positioned in the inkjet printing system 1 away from the printhead assembly 3.

The printhead assembly 3 includes one or more printheads which eject ink droplets from the plurality of nozzles 5 onto the print medium 7. Ink flows from the ink reservoir 4 to the printhead assembly 3, thereby supplying the printhead assembly 3 with ink. The printhead assembly 3 and the ink reservoir 4 can comprise a one-way ink delivery system in which substantially all of the supplied ink is ejected towards the print medium 7. Alternatively, the printhead assembly 3 and the ink reservoir can comprise a recirculating ink delivery system in which only a portion of the supplied ink is ejected towards the print medium 7, and the remaining portion is returned to the ink reservoir 4.

In certain embodiments, the printhead assembly 3 and the ink reservoir 4 are housed together in an ink cartridge 2, as illustrated in FIGS. 2 and 3. In other embodiments, the printhead assembly 3 and the ink reservoir 4 are separate and coupled together by a fluidic connection through which ink flows. The ink reservoir 4 can comprise multiple reservoirs (e.g., a local reservoir located within the ink cartridge 2 and a separate, larger reservoir located away from the ink cartridge 2 which serves to supply the local reservoir with ink). In any of these embodiments, the ink reservoir 4, or its sub-reservoirs, can be removed, replaced, and/or refilled.

In certain embodiments, the nozzles 5 are arranged in arrays of one or more rows. By ejecting ink from the nozzles 5 in a predetermined order as the relative position of the printhead assembly 3 and the printing medium 7 is scanned, characters, symbols, and/or other graphics or images can be printed onto the print medium 7. The mounting assembly 8 positions the printhead assembly 3 and the media transport assembly 10 positions the print medium 7. One or both of the mounting assembly 8 and the media transport assembly 10 can be scanned in response to commands from the electronic controller 9 to scan the relative position of the printhead assembly 3 and the print medium 7.

The electronic controller 9 can comprise logic and drive circuitry and is coupled to the printhead assembly 3, the mounting assembly 8, and the media transport assembly 10. In addition, the electronic controller 9 is coupled to a host device (e.g., a computer), from which it receives and stores data. In response to the data from the host system, the electronic controller 9 sends appropriate control signals to the printhead assembly 3, the mounting assembly 8, and the media transport assembly 10 to provide the desired printed images on the printing medium 7. The control signals from the electronic controller 9 can include timing control signals for the ejection of ink droplets from the nozzles 5 coordinated with relative movements of the printhead assembly 3 and the print medium 7.

Figure 2A:
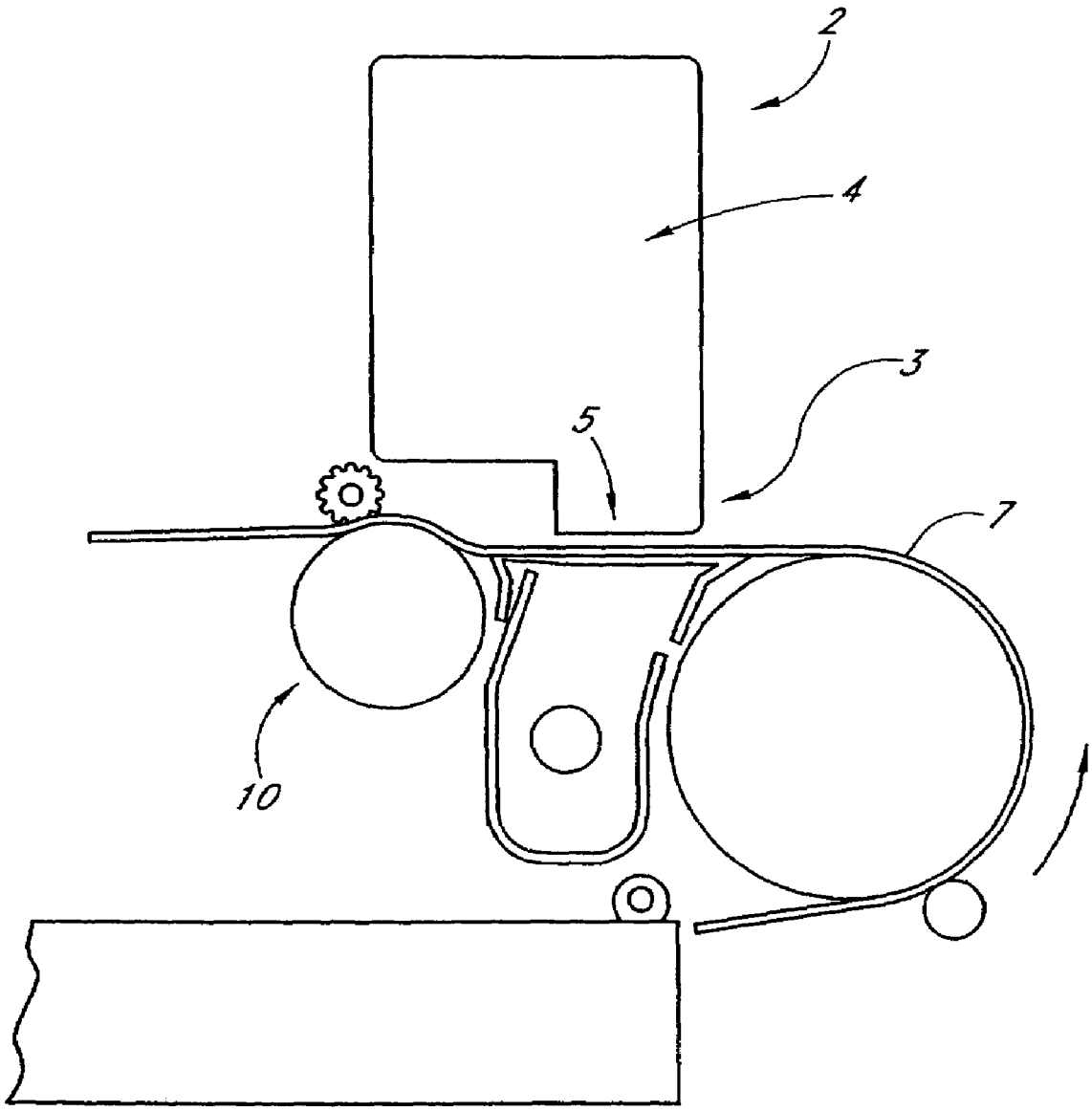
FIG. 2A schematically illustrates a view of an embodiment of the ink cartridge in proximity to a sheet of paper serving as the print medium.

FIG. 2A schematically illustrates a view of an embodiment of an ink cartridge 2 in proximity to a sheet of paper serving as the print medium 7. The ink cartridge 2 of FIG. 2A comprises the printhead assembly 3 and the ink reservoir 4 in an integral unit, which can be replaceable. The nozzles 5 of the ink cartridge 2 are positioned close to the print medium 7, and as the print medium 7 is advanced by the media transport assembly 10, ink is ejected from the nozzles 5 in a coordinated manner to form the desired images on the print medium 7.

Figure 2B:
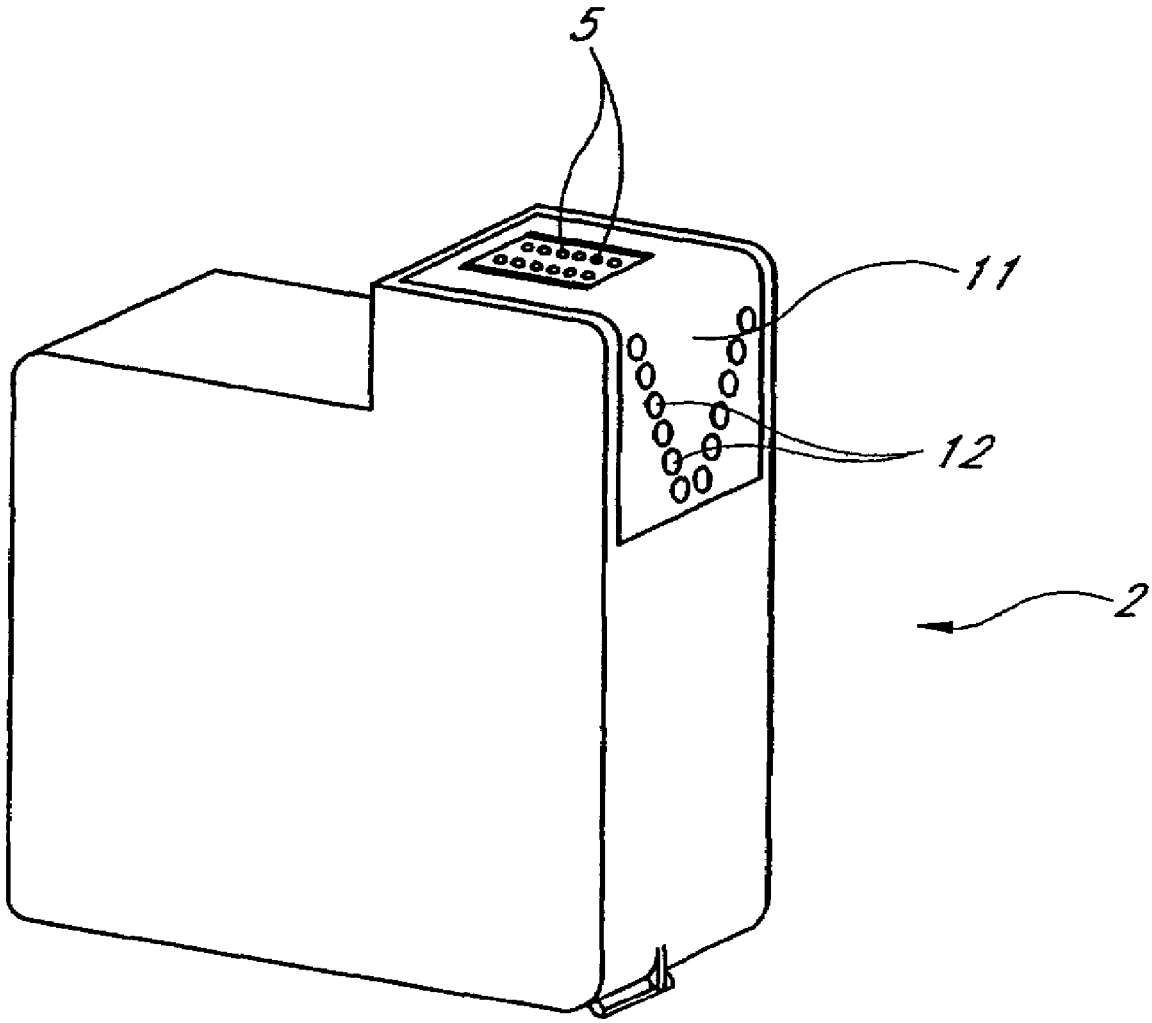
FIG. 2B schematically illustrates a view of one embodiment of the ink cartridge.

FIG. 2B schematically illustrates another view of the ink cartridge 2 in isolation from the other components of the inkjet printing system 1. The ink cartridge 2 includes an electrical connector 11 comprising a plurality of conductive pads 12 which provide electrical coupling between the printhead assembly 3 and the electronic controller 9. The electrical connector 11 is adapted to facilitate the ink cartridge 2 serving as a replaceable component of the inkjet printing system 1 by providing an easy connect/disconnect electrical conduit between the ink cartridge 2 and the electronic controller 9.

Figure 3A:
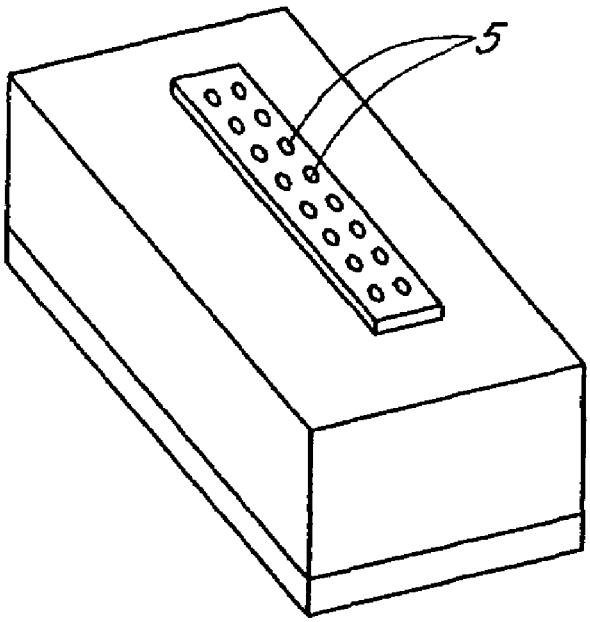
FIGS. 3A and 3B schematically illustrate two views of another embodiment of the ink cartridge.
Figure 3B:
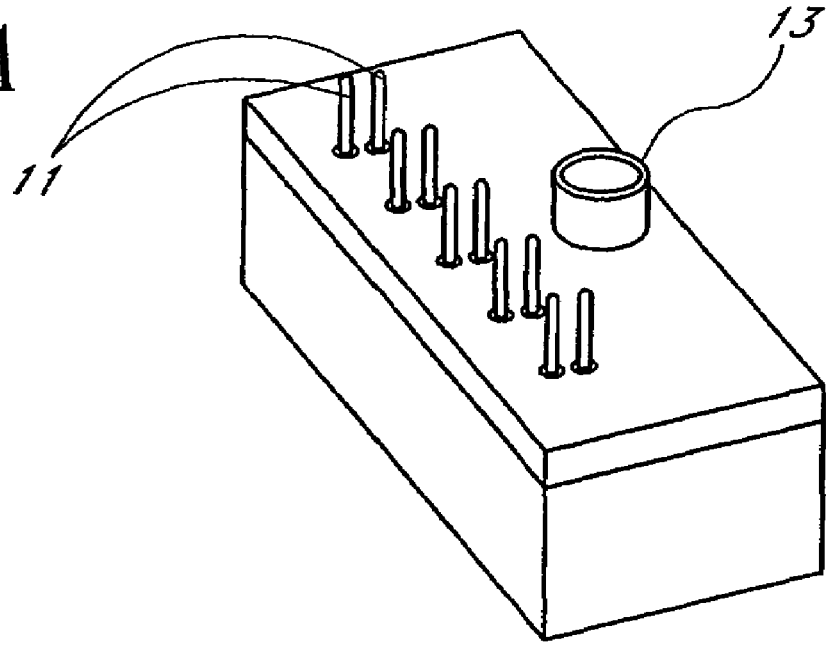
Figure 4A:
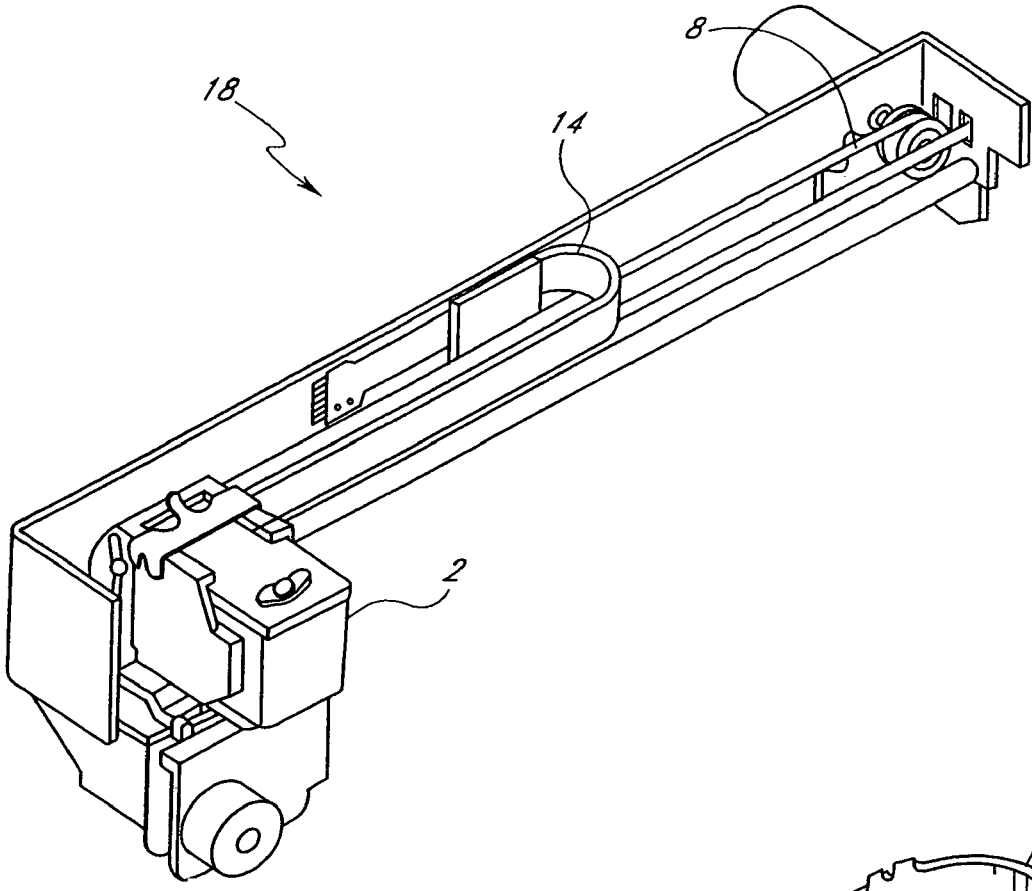
FIGS. 4A and 4B schematically illustrate one embodiment of the ink ejecting apparatus in which the ink cartridge is optically coupled to a plurality of laser diodes by an optical ribbon cable.
Figure 4B:
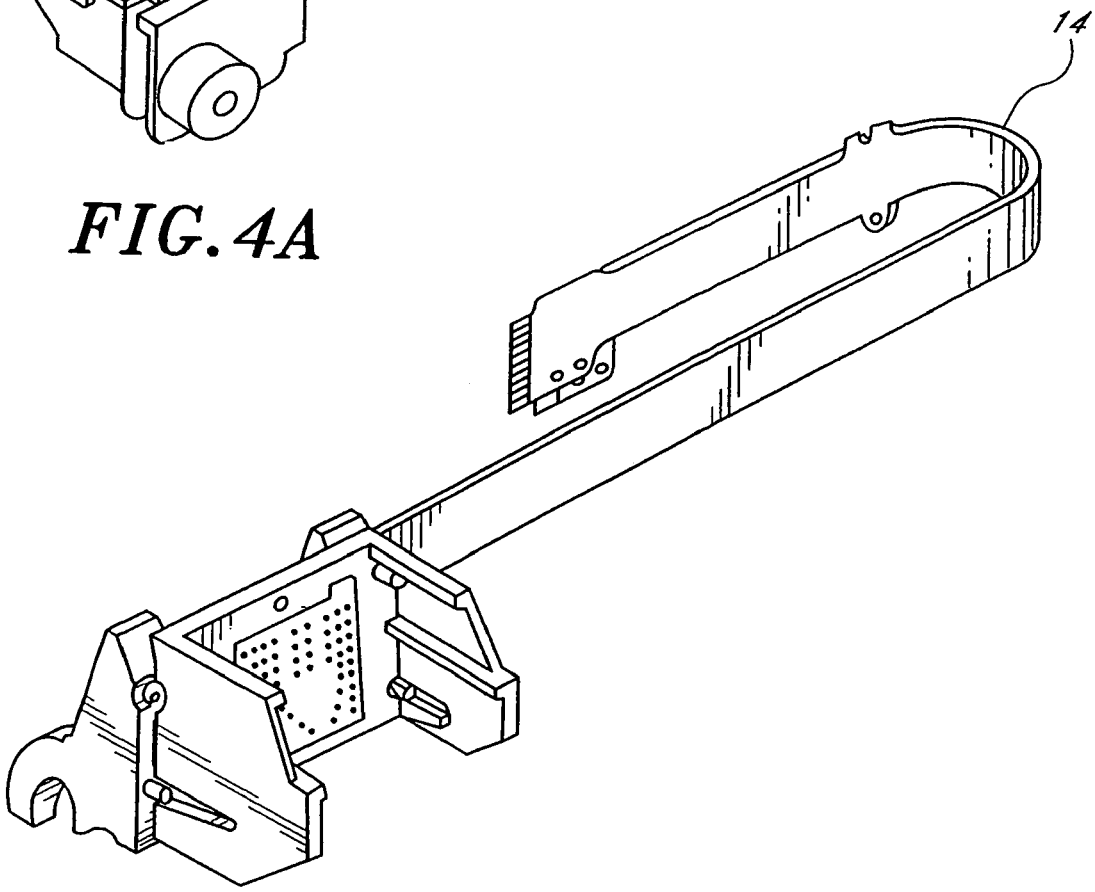

FIGS. 3A and 3B schematically illustrate two views of another embodiment of the ink cartridge 2 in which the ink reservoir 4 is separated from the printhead assembly 3. The ink cartridge 2 comprises the plurality of nozzles 5 and a plurality of electrical connectors 11. In addition, the ink cartridge 2 comprises a fluidic conduit 13 for the transfer of ink from an ink reservoir 4 to the ink cartridge 2.

FIG. 4A schematically illustrates an embodiment of the ink ejecting apparatus 18 in which an optical ribbon cable 14 optically couples a plurality of laser diodes 15 with the printhead assembly 3. FIG. 4B schematically illustrates the optical ribbon cable 14. The plurality of laser diodes 15 are at a fixed position in the inkjet printing system 1 and the ink cartridge 2 and printhead assembly 3 are scanned laterally by the mounting assembly 8. The optical ribbon cable 14 has sufficient flexibility to maintain optical connection between the plurality of laser diodes 15 and the ink cartridge 2 throughout the range of motion of the ink cartridge 2.

Figure 5:
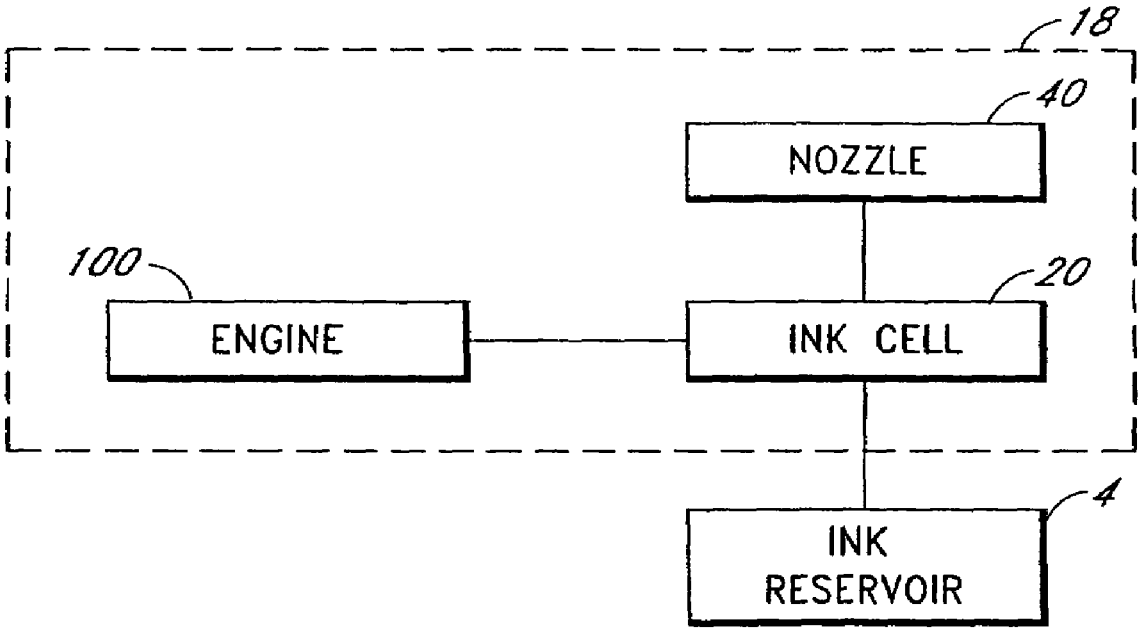
FIG. 5 schematically illustrates an embodiment of an ink ejecting apparatus coupled to an ink reservoir.

FIG. 5 schematically illustrates an embodiment of the ink ejecting apparatus 18 apart from the rest of the printing system. The ink ejecting apparatus 18 includes one or more ink cells 20, each cell 20 containing a volume of ink. For this purpose, each cell 20 communicates with an ink supply, as described in more detail below. Each ink cell 20 also communicates with a nozzle 40. The nozzle is adapted to eject ink for printing purposes as described above. The ink ejecting apparatus 18 also comprises an engine or driver 100. The engine 100 selectively causes ink to eject from the nozzle 40. In particular, the engine causes a displacement of ink within the ink cell 20 toward the nozzle 40 to eject ink outward, e.g., towards the print medium.

In the illustrated embodiment, the engine 100 includes at least one moving member that selectively moves within the engine 100. At least a portion of this movement is transmitted to the ink cell 20 (preferably either in the form of a pressure or displacement wave) to create an ejection event. The following embodiments depict various arrangements and interactions between the engine 100 and the ink cell 20 to create an ejection event.

Figure 6A:
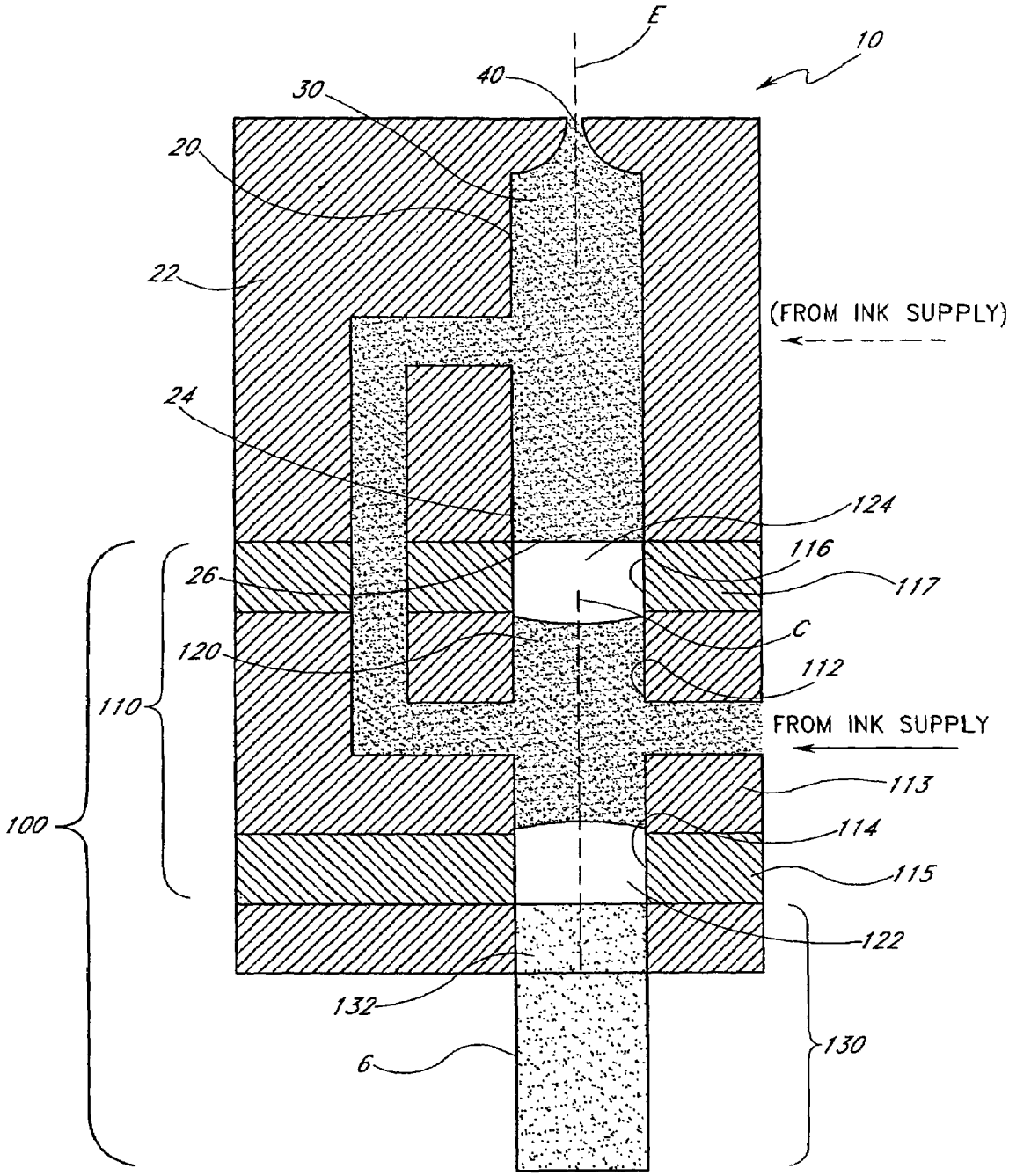
FIG. 6A schematically illustrates an embodiment of the ink ejecting apparatus in which the engine includes a chamber, a liquid mass, and a source of laser light.
Figure 6B:
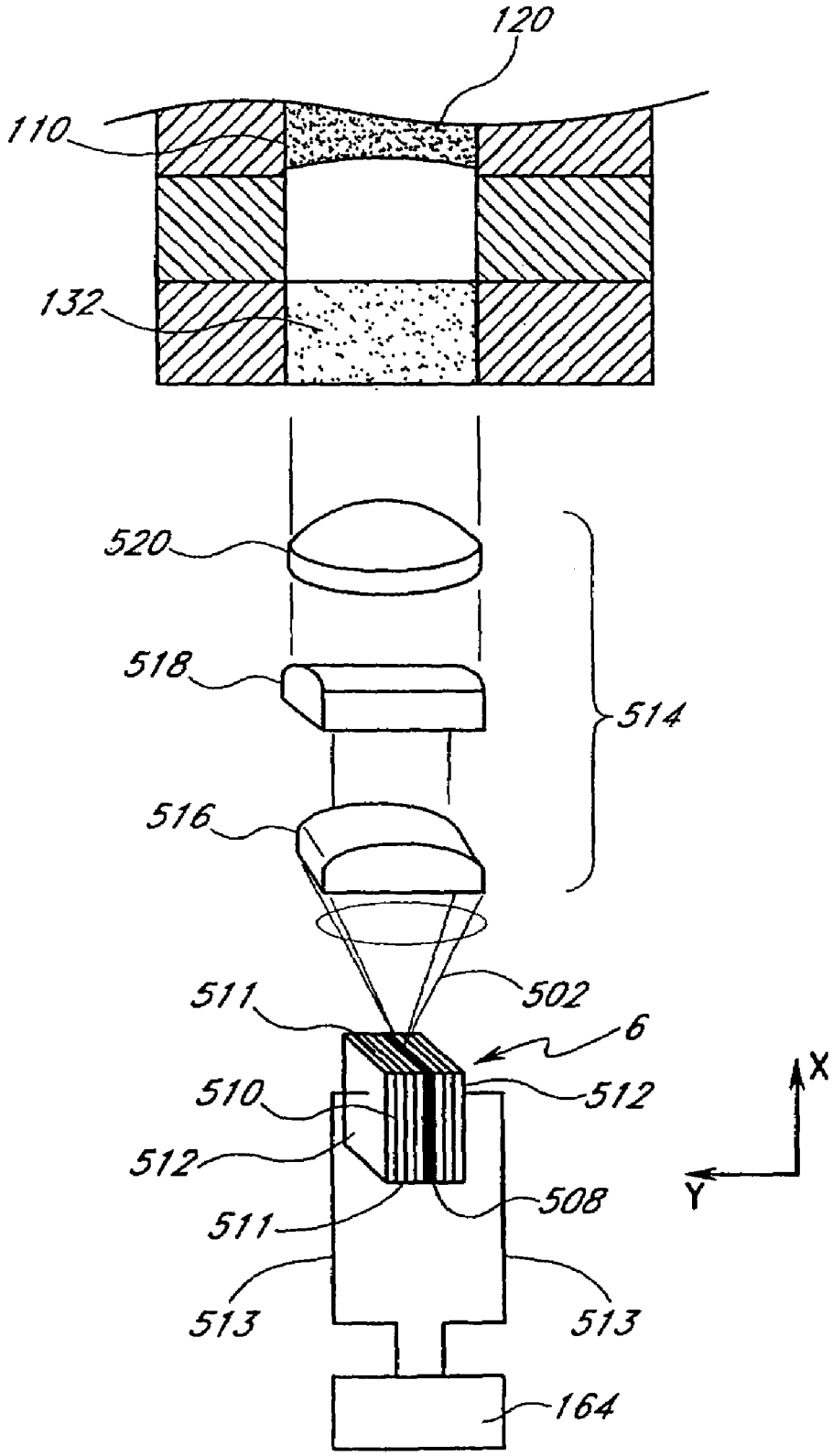
FIG. 6B schematically illustrates the source of laser light coupled to the chamber of the engine shown in FIG. 6A.

With reference to FIGS. 6A and 6B, the engine 100 of the illustrated ink ejecting apparatus 18 is aligned with the ink cell 20 and the nozzle 40. In this form, an ejection axis E of the nozzle 40 lies generally collinear with a reciprocal axis C of the engine 100. The ink cell 20 thus is interposed between the engine 100 and the nozzle 40 with all of these components aligning along a common axis.

The engine 100 includes a chamber 110 and a liquid mass 120 positioned to oscillate within the chamber 110 at an oscillation frequency. The engine 100 further includes a source 130 of electromagnetic energy that energizes the liquid mass 120. The source 130 is adapted to drive the liquid mass 120 to oscillate at the oscillation frequency by exposing a portion of the liquid mass 120 to electromagnetic energy, which in some modes can occur in one or more pulses. The engine 100 is arranged such that oscillatory movement of the liquid mass 120 is at least partially transmitted to the ink 30 within the ink cell 20 so as to selectively eject ink 30 through the nozzle 40.

For the purpose of describing various components of the engine 100 and the ink cell 20 of the ink ejecting apparatus 18 of the illustrated embodiments, these components will be described in reference to the energy source 130 (or a first energy source) of the engine 100. Thus, for example, "proximal" will be used to indicate a location or direction near or towards the energy source 130 and "distal" will be used to indicate a location or direction away from the energy source 130.

The ink cell 20 comprises a volume containing ink 30. In the embodiment illustrated schematically in FIG. 6A, the ink cell 20 is a generally cylindrical volume within a chamber housing 22; however, other shapes are practicable. The ink cell 20 preferably is made of a material having a high affinity for the ink 30 or alternatively it can be lined with an appropriate material having a high affinity for the ink 30 (e.g., copper). Furthermore, for embodiments which use semiconductor processing technology to fabricate the ink cell 20, exemplary materials include, but are not limited to, silicon, silicon oxide, silicon carbide, silicon nitride, tantalum, aluminum, TaAl, and gold. The ink cell 20 can have dimensions (e.g., a diameter) on the order of 0.1 millimeters. The ink cell 20 also can be similar to those currently made by Canon, Hewlett-Packard, or Epson. Exemplary ink cells 20 are described by Aden et al. in "The Third-Generation HP Thermal InkJet Printhead," Hewlett-Packard Journal, February 1994, pp. 41-45, which is incorporated in its entirety by reference herein. In the illustrated embodiment, at least a distal portion of the inner surface 24 of the ink cell 20 has a high affinity for the ink 30.

The ink 30 is preferably adapted to absorb at least a portion of the electromagnetic energy from the source 130. Inks that are compatible with embodiments described herein include, but are not limited to, inks which are compatible with thermal ink-jet technology, piezoelectric ink-jet technology, or both. The ink 30 can be water-based, hydrocarbon-based, or isoparaffin-based, and can comprise anionic dispersants or anionic (sulfonated) dyes. The ink 30 preferably has a viscosity and surface tension compatible with use in ink cells 20 and nozzles 40 as described herein. Additionally, as is described more fully below, the ink 30 within the ink cell 20 has a proximal free surface 26 that interacts with the engine 100.

The nozzle 40 provides an orifice through which the ink 30 within the ink cell 20 is ejected towards the print medium. In certain embodiments, the nozzle 40 has a diameter of approximately 25 microns and can hold a pressure differential between the ink 30 and the surrounding atmosphere of approximately 0.5 MPa by surface tension. Other configurations of the nozzle 40 are compatible with embodiments described herein. Exemplary configurations are described in various prior art references regarding thermal ink jet technology and piezoelectric ink jet technology (see, e.g., U.S. Pat. No. 4,490,728 issued to Vaught et al., U.S. Pat. No. 4,480,259 issued to Kruger et al., U.S. Pat. No. 4,336,544 issued to Donald et al., and U.S. Pat. No. 3,832,579 issued to Arndt, which are incorporated in their entirety by reference herein). As described more fully below, the engine 100 preferably provides the ink cell 20 with oscillating pressure to eject ink droplets from the nozzle 40.

As seen in FIG. 6A, the liquid mass 120 that moves (e.g., reciprocates) within the chamber 110 in the illustrated engine 100 between a proximal volume of vapor 122 and a distal volume of vapor 124. The vapor in both the proximal and distal volumes 122, 124 is compressible such that each volume is variable. Both volumes 122, 124 preferably are filled with the same type of vapor (e.g., air and ink vapor).

In the illustrated embodiment, the chamber 110 has a cylindrical shape, preferably of the same diameter as the ink cell chamber housing 22, however, other shapes are practicable. While the engine 100 can be employed on larger scales, the inside diameter of the cylindrical chamber 110 for its application in the ink ejecting apparatus 10 is preferably not greater than about 1 millimeter, and more preferably on the order of 0.1 millimeter. The small diameter of the chamber 110 also provides a capillary action to help maintain the integrity of the liquid mass 120 during operation.

The liquid mass 120 preferably is fluidly coupled to the ink cell 20 and to an ink reservoir 4. In other embodiments, however, the ink cell 20 can comprise the ink reservoir 4. The ink reservoir 4 contains a supply of ink to replenish the ink 30 in the ink cell 20 and liquid mass 120. In certain other embodiments, the ink reservoir 4 is directly fluidly coupled to the ink cell 20, as indicated by the dashed arrow in FIG. 6A.

The ink reservoir 4 can be pressurized to facilitate transfer of ink 30 from the ink reservoir 4. The pressure within the ink reservoir 4 is preferably higher than the average pressure within the ink cell 20. For example, where the average pressure within the ink cell 20 is about 5 atmospheres, the ink reservoir 4 can be pressurized to about 5.5 atmospheres. Other means to facilitate the transfer of ink 30 from the ink reservoir 4 are practicable with embodiments described herein. Examples include, but are not limited to, gravitational, pumped, or acoustically-induced flow. Additionally, a one-way valve can be positioned between the ink reservoir 4 and the liquid mass 120 to inhibit backflow of ink 30 to the ink reservoir 4.

As is described more fully below, the liquid mass 120 serves as a liquid piston that provides impulses to the ink 30 within the ink cell 120. The liquid mass 120 comprises a compound which absorbs at least a portion of the electromagnetic energy emitted by the source 130. The liquid mass 120 preferably comprises the same ink 30 that is within the ink cell 20; however, the liquid mass can comprise other materials. Other materials for the liquid mass 120 compatible with embodiments described herein include, but are not limited to, fluids with low latent heats, water, hydrocarbons (e.g., 1,2-dichloroethane), and petrafluorine. In addition, the liquid mass 120 can comprise an additive which absorbs one or more wavelengths of the electromagnetic energy from the source 130. For example, a dye is preferably added to the liquid of the liquid mass 120 to increase absorption of the input electromagnetic energy from the source 130. To facilitate high absorption for wavelengths emitted by laser diodes in the near-infrared (NIR) region, one or more of the following NIR dyes can be added to the liquid mass 120: "Styryl 9" with a peak absorption at 840 nanometers, "Hitci" with a peak absorption at 875 nanometers, and "IR140" with a peak absorption at 960 nanometers. These dyes are available commercially from Lambda Physik AG of Gottigen, Germany. In addition, dyes available from H.W. Sands Corp. of Jupiter, Fla. may be used, including but not limited to, SDB1217 for 800 nanometers, SDA2141 for 810 nanometers, SDA5324 for 920 nanometers, and SDA8336 for 980 nanometers. The concentration of the dye can be tailored to match the required optical density (e.g., absorption depth on the order of 5 microns).

In certain embodiments, the source 130 of electromagnetic energy comprises a source of electromagnetic waves (e.g., infrared, ultraviolet, RF, x-ray). Suitable sources of electromagnetic waves include lasers, e.g., laser diodes. The source 130 of electromagnetic energy can be an integral component of the ink ejecting apparatus 18 or it can be a replaceable component that is reversibly separable from the other components of the apparatus 18. In addition, the source 130 can comprise a laser diode positioned away from the engine 100 but optically coupled to the engine 100 by optical fibers.

In the present embodiment illustrated in FIGS. 6A and 6B, the engine 100 includes a window 132 and a laser diode 6. The window 132 is substantially transparent to at least a portion of the electromagnetic energy generated by the laser diode 6, thereby allowing electromagnetic energy from the laser diode 6 to enter the chamber 110 and to interact with the liquid mass 120. In the embodiments illustrated by FIGS. 6A and 6B, the window 132 seals the proximal end of the chamber 110. In certain embodiments, the window 132 comprises an optical fiber and/or one or more lenses (e.g., a collimating lens) for transmitting the electromagnetic energy from the laser diode 6 to the liquid mass 120. The laser, the waveguide, and/or the window thus can be considered as a "source of electromagnetic energy" and, more particularly, as a "source of laser light." Additionally, in some forms of the apparatus 18, at least portions of the laser (or laser diode), the waveguide and/or the window can be readily replaceable components.

In other embodiments, the source of electromagnetic energy 130 comprises a pair of electrodes adapted to create an electrical discharge which impinges a portion of the liquid mass 120. An exemplary electrical discharge source as used in the field of soft tissue cutting and removal in the medical field is described in U.S. Pat. No. 6,352,535 issued to Lewis et al. and by Palanker et al. in "Electric Alternative to Pulsed Fiber-Delivered Lasers in Microsurgery," J. Appl. Phys. Vol. 81, pp. 7673-7680, Jun. 1, 1997, both of which are incorporated in their entirety by reference herein. In certain such embodiments, an additive is included in the liquid mass 120 to increase the surface conductivity of its free surface (e.g., electrophoresis). In some applications, only a single electrode can be used where the ink itself is grounded to function as a second electrode.

In the illustrated embodiment, the laser diode 6 emits pulses of electromagnetic radiation which are preferably short enough to ensure rapid formation of a superheated layer of the liquid mass 120 and a resulting gas bubble as described more fully below. The frequency of the laser pulses preferably substantially matches the natural frequency of the liquid mass 120. The wavelength range of the laser light preferably includes at least one wavelength absorbed by the liquid mass 120. In certain embodiments, the range is 0.75 microns to 2.5 microns (near-infrared range), while in other embodiments the range is in the ultraviolet (UV) region (e.g., 0.2-0.3 microns), which can be supplied by excimer lasers.

One or more laser diodes preferably are used as the source of electromagnetic energy because laser diodes are small, reliable, inexpensive and emit a sufficiently large density of optical power. In addition, laser diodes currently available can be modulated to produce short optical pulses at a high repetition rate. Thus, the laser diode can provide pulses at a repetition rate to oscillate the liquid mass 120 at its natural frequency within the chamber 110. The energy density is preferably sufficient to vaporize during a single pulse substantially the entire area of the proximal surface 126 of the liquid mass 120 to a selected depth, starting from an ambient liquid temperature.

Suitable laser energy can be generated by semiconductor emitters such as those made of III-V materials like gallium arsenide (GaAs) and aluminum gallium arsenide (AlGaAs). Other semiconductor and non-semiconductor light sources may be employed, both those well known in the art as well as those yet to be devised. Organic light sources are examples of sources for generating light by using materials other than traditional semiconductors.

In the case where a plurality of engines 100 are employed, an array of light sources 130 may be used, as will be described in more detail below. A one or two-dimensional array may be suitable depending on the arrangement of the engines 100. The light sources 130 are preferably small in size since the engines 100 and associated ink cells 20 are spaced close to one other. For example, the pitch of the array of light sources may be, without limitation, between about 200 to 500 microns, being about 250 microns in one exemplary embodiment.

In addition, because the small size of the cells 20 and the volume of liquid to be heated, the beam of light that is directed into the liquid is preferably small. This beam may have a diameter in the range, for example, between about 25 microns and 250 microns and may be about 100 microns across in one design, although larger and smaller beam sizes are possible. The size of the beam preferably is on an order of magnitude of the size of the nozzle and can be smaller than the diameter of the chamber 110; however, the beam size can also be shaped and sized to match the cross-sectional shape and size of the chamber 110, as described below.

FIG. 6B schematically shows the laser diode 6 outputting a beam 502 of light for heating a volume of the mass liquid 120 contained in a chamber 110. A single die is schematically depicted without the packaging that is commonly included with off-the-shelf laser diodes. In this example, the laser diode 6 comprises an edge emitting diode with light being emitted from the side of the die (i.e., generally parallel to its layers).

As shown, the laser diode 6 comprises a plurality of layers of material that together form a heterostructure. The layers shown are only exemplary and the arrangement and size of these layers may vary for differently designed structure. In one preferred example, the laser diode 6 comprises III-V semiconductor material, such as, for example a GaAs/AlGaAs heterostructure, with various layers comprising GaAs and AlGaAs. The laser 6 includes an active layer 508 which provides gain and from which the laser light is emitted. In one embodiment, the active layer 508 is approximately 100 microns wide and 1 micron thick. The disparity in these dimensions results in an astigmatic beam, i.e., the beam diverges more in the Y-direction than in the X-direction, as shown in FIG. 6B.

The laser diode 6 further comprises cladding layers 510 which confine the light in the Y-direction within the laser diode 6. The physical properties (e.g., thickness, composition, refractive index, and doping or conductivity) of the various layers, including the cladding layers 510, can be selected so as to tailor the laser diode output. For example, a laser diode 6 may have beam divergences of approximately 30° to approximately 60° in the Y-direction and up to about 20° in the X-direction, and peak laser power on the order of about 5 watts. At a 10% duty cycle and 3% on time, the actual power is about 15 milliwatts for text, and for color image printing it will be up to 150 milliwatts. For a given modulation cycle of the laser, "duty cycle" refers to the amount of time that the laser diode is active expressed as a percentage of the modulation period. "On time" refers the amount of time that a given laser diode is being modulated expressed as a percentage of the total printing time. By judicious selection of the thickness and refractive index of the cladding layers 510 of the laser diode 6, the divergence of the laser beam can be controlled to some extent.

Facets 511 on opposite sides of the die confine light within one direction. The cladding 510 and the facets 511 together create an optical cavity in which lasing may occur. As indicated above, the laser diode 6 shown in FIG. 6B is a edge emitting diode as light is emitted from the active layer 508 from the side of the laser die, i.e., from the facets 511 in the X-direction. In other embodiments, the laser diode 6 may comprise a vertical cavity surface emitting laser, wherein the light is output through one of the cladding layers 510 in the Y-direction (see FIG. 6B). Other designs, both those well known in the art as well as those yet to be developed, are also considered possible. For example, the laser diode 6 may include distributed Bragg reflectors and/or Bragg grating or various other features for controlling or manipulating the laser light that is output from the laser diode 6.

Electrical contacts 512 are formed with the diode 6 to provide electrical energy to this device. This electrical energy is converted into optical energy in the active region 508 of the laser 6. The laser diode 6 is biased and the electrical signal applied thereto is modulated to cause optical pulses to be output from the laser diode 6. Electrical circuitry 164 for biasing and modulation may be included on a silicon integrated circuit which is electrically coupled to the diode 6 by electrical leads 513. In other embodiments, the laser diode 6 can be mounted onto the silicon integrated circuit for example with flip-chip bonding or by other mounting and bonding techniques. In still other embodiments, the electrical circuitry 164 may comprise a GaAs integrated circuit formed on a GaAs substrate. The laser diode 6 may be mounted to this GaAs substrate or the laser diode 6 and the circuitry 164 may be formed of one monolithic III-V semiconductor structure.

Preferably, the laser diode 6 generates optical pulses less than about 1 microsecond in duration. The pulses are preferably output at a repetition rate of at least 50,000 reps per second. The duty cycle ratio on to off of the laser during single cycle is preferably less than about 50%, and more preferably less than about 10%. In one preferred embodiment, the laser diode 6 operates in pulsed mode and generates approximately 200 nanosecond pulses at a repetition rate of about 500,000 reps per minute with an approximately 10% duty cycle. In this case, the 200 nanosecond pulses are separated by 2 microsecond periods where the laser diode 6 is not outputting an optical beam. In certain embodiments, an external modulator may alternatively be employed to modulate light output from the laser diode 6.

The laser diode 6 may include heat sinks (not shown) such as metal elements attached thereto to dissipate thermal energy produced when the diode 6 is powered with electricity. These heat sinks may take other forms depending on the specifications and design of the structure. In one exemplary embodiment wherein the laser diode 6 operates at a duty cycle of about 10% and a 3% on-time (for text), the total average power of the laser to be dissipated is about 15 mW.

Exemplary laser diodes 6 may be available from manufacturers such as, for example, Sony and JDS Uniphase. Other manufacturers may also provide suitable laser diodes 6. Still, in the future, more suitable laser diodes 6 may be developed that may be used.

As shown in FIG. 6B, beam shaping optics may be included with the laser diode 6 to tailor the shape of the beam as desired. These beam shaping optics 514 can comprise first and second cylindrical lenses 516, 518 that reduce the divergence of the beam in the Y and X directions, respectively. For example, in the case where the beam diverges at an angle of about 40 degrees in the Y-plane and about 15 degrees in the X-plane, the first lens 516 will be curved along the Y-direction and the second lens 518 will have curvature in the X-direction, the curvature of the first lens 516 exceeding that of the second lens 518. Preferably, the curvature and separation of these two lenses are selected such that the angle of divergence in the Y and X directions after propagating through the two lenses is substantially the same and the beam will be circular instead of elliptical. In certain preferred embodiments these two lenses are combined in a single cylindrical or anamorphic lens with different optical power in the two orthogonal directions. In such a case, the lens may be placed sufficiently close to the laser diode 6 such that the resultant beam is circularly shaped and preferably not substantially elliptically shaped.

The beam-shaping optics schematically depicted in FIG. 6B further comprises a collimating lens 520 that receives the diverging beam from the laser diode 6 after propagating through the first and second cylindrical lenses 516, 518. This collimating lens 520 preferably has an optical power and is positioned in the optical path of the beam so as to produce substantially collimated laser light. Preferably, this collimating lens 520 is distanced from the laser diode 6 such that the beam has the appropriate size. In one preferred embodiment, wherein the liquid to be illuminated has a 100 micron cross-section, preferable the optical beam also has a cross-section with diameter of about 100 microns.

In other embodiments, the properties of this collimating lens 520 may also be incorporated in the cylindrical lenses. For example, each cylindrical lens could collimate the beam in one direction, i.e., in one of the Y and X directions. Alternatively, a single lens element may provide the appropriate amount of optical power in the two orthogonal directions to collimate the beam in both directions. In such a case the lens may be placed sufficiently close to the laser diode 6 such that the resultant beam is circularly shaped and preferably not substantially elliptically shaped.

In still other embodiments, the output of the light source may be a circular beam which does not require substantial astigmatic correction. A collimating lens 520 may be used to collimate the beam. Also, in other preferred embodiments wherein the laser output is Gaussian, an optical lens may be employed to locate the Gaussian beam waist generally at the liquid surface. The beam will therefore be collimated at that location and will also have a reduced beam size so as generally to match the diameter of the chamber 110.

As discussed above, FIG. 6B is schematic and presented for illustrative purposes only. For example, although convex lens elements are shown in FIG. 6B, other types of optical elements may employed to shape the beam. These optical elements may include but are not limited to diffractive optics such as holographic optical elements, reflective optics such as non-imaging optical elements, and/or graded index lenses. Also as discussed above, the variety of optical functions of each of the optical elements comprising the beam shaping optics may be alternatively incorporated in one, two, three, or more separate optical elements. In addition to the beam shaping optics shown, other optical elements that alter the optical properties of the beam may be employed as appropriate.

FIG. 6B also shows the optical beam after propagating through the beam shaping optics and passing through the window 132. As discussed above, heating is achieved by illuminating the liquid with the optical beam that passes through the window 132 and enters the chamber 110.

Accordingly, the window 132 preferably comprises material that is substantially optically transmissive to the wavelength of light emitted by the laser source that is absorbed by the liquid. As described above, this window 132 also preferably comprises a material and has a thickness so as to contain the liquid explosions. This window 132 may comprise, for example, plastic, silica glass or crystal, such as sapphire, although sapphire is more expensive.

In certain preferred embodiments, the function of the beam shaping optics may be incorporated at least in part in the window 132. For example, the window 132 may have optical power in one or two or more directions to alter the divergence of the beam. In one preferred embodiment, the window 132 may be curved in the Y or X direction (or both) so as to collimate the beam in the Y and X directions. In this case, the window 132 may be butt coupled to the laser diode 6 with the glass adjacent the output facet of the die. In such a configuration, preferably the thickness of the window 132 is selected so that the diverging beam has the desired size when it is collimated. This thickness, may for example be approximately 100 to 250 microns in some cases, although the window may have other thickness.

The window 132 need not perform all the functions of the beam shaping optics but only some and may be included together with one or two additional optical elements. Also, the lensing properties of the window 132 need not be accomplished by introducing curvature into the window 132. In other embodiments, for example, the window 132 may include index variations or diffractive features tailored to shape the beam as desired.

The laser diode 6 is schematically shown as a die in FIG. 6B. Laser diodes 6, however, may be purchased in a package that includes a heat sink and a window or optical element as well as electrical leads. Some or all of this packaging may be removed in certain embodiments to provide the desired beam properties or to accommodate the particular design.

In an alternative embodiment, the laser diode 6 is optically coupled to an optical fiber, as noted above. Light output by the laser diode 6 propagates through the optical fiber and exits its distal end which may be located adjacent the chamber 110. As described above, beam shaping optics may be employed to tailor the shape of the beam exiting the optical fiber. These beam shaping optics may be incorporated in the window 132 of the chamber 110. In certain embodiments, the length of the optical fiber is sufficiently long so as to homogenize the beam such that the output therefrom is not astigmatic. Accordingly, the beam shaping optics preferably do not have astigmatic correction. A collimator, however, may be located at the distal end of the fiber to collimate the beam that is directed into the liquid. As described above, in various preferred embodiments, a plurality of laser diodes 6 are employed to heat liquid within a plurality of engines 100. In such embodiments, a plurality of optical fibers may optically connect the light sources to the chambers 110 of the engines. One or more optical elements such as gradiant index lenses or other components well known in the art may optical couple the light from the laser diode 6 to the optical fiber. Laser diodes optical coupled to fibers are readily available and may be obtained from JDS Uniphase and other manufacturers.

With reference back to FIG. 6A, the chamber 110 has sufficient length to accommodate the liquid mass 120 and to provide for its reciprocation in the chamber 110 between the proximal volume 122 and the distal volume 124. The chamber length preferably provides the liquid mass 120 with a sufficient stroke for the engine 100 to expel ink 30 from the ink cell 20 through the nozzle 40. In certain embodiments of the ink ejecting apparatus 10, the length of the chamber 110 is preferably less than 1 millimeter, and more preferably less than about 0.5 millimeters.

The chamber 110 is preferably constructed to cause the liquid mass 120 to migrate toward a generally central position within the chamber 110 when the engine 100 is not operating. Accordingly, different parts of the chamber wall preferably exhibit different affinities for the liquid mass 120. In the embodiment illustrated by FIG. 6A, the chamber wall comprises at least three parts that define the chamber 110: a central part 112 having a high affinity for the liquid mass 120; a proximal part 114 having a low affinity for the liquid mass 120; and a distal part 116 also having a low affinity for the liquid mass 120. In certain embodiments, the central part 112, proximal part 114, and distal part 116 of the chamber wall are the inner surfaces of the corresponding central engine housing 113, proximal engine housing 115, and distal engine housing 117. The desired affinities for the liquid can be provided by the materials of the corresponding engine housings, coatings on the corresponding inner surfaces of the engine housings, or by a combination thereof.

The proximal engine housing 115 and the distal engine housing 117 are preferably made of a thermally insulating material with an inner surface having a low affinity for the liquid mass 120, resulting in close to adiabatic compression and expansion of the vapor in the proximal volume 122 and the distal volume 124. One suitable thermally insulating material is polytetrafluoroethylene (PTFE), available commercially as Teflon™ from E.I. du Pont and Nemours and Company. In embodiments in which the proximal volume 122 is sealed by the window 132, the window material also preferably has a low affinity for the liquid mass 120. The central housing 113 is preferably made of a thermally conductive material (e.g., copper) with an inner surface having a high affinity for the liquid mass 120.

In the illustrated embodiment, the proximal free surface 26 of the ink 30 within the ink cell 20 defines one end of the distal volume 124. As used herein, the term "free surface" of a liquid refers to the liquid-vapor interface that defines one boundary of the liquid. In contrast, the surfaces of the liquid in contact with the chamber walls are defined by liquid-solid interfaces.

Figure 6C:
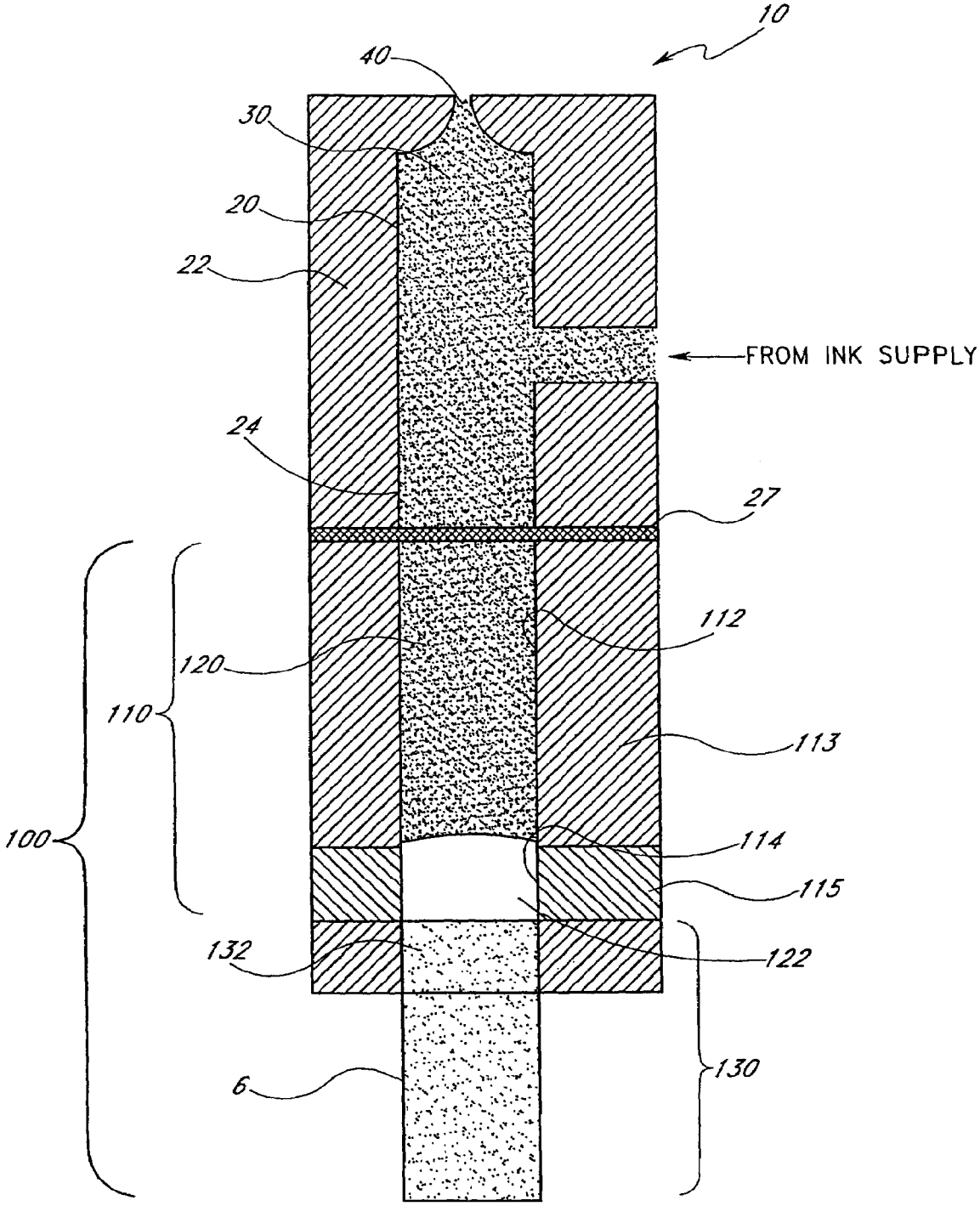
FIG. 6C schematically illustrates an embodiment of the ink ejecting apparatus which includes a flexible membrane between the ink cell and the engine.

As is described more fully below, impulses generated by the liquid mass 120 as it oscillates within the chamber 110 are at least partially transmitted to the ink 30 within the ink cell 20 through the proximal free surface 26 of the ink 30 within the ink cell 20. In certain other embodiments, the proximal surface of the ink 30 within the ink cell 20 is bounded by a flexible membrane 27, as schematically illustrated in FIG. 6C. An exemplary material for the membrane is a superelastic, shape memory material, such as Ni—Ti alloy, available commercially as Nitinol™.

Figure 7A:
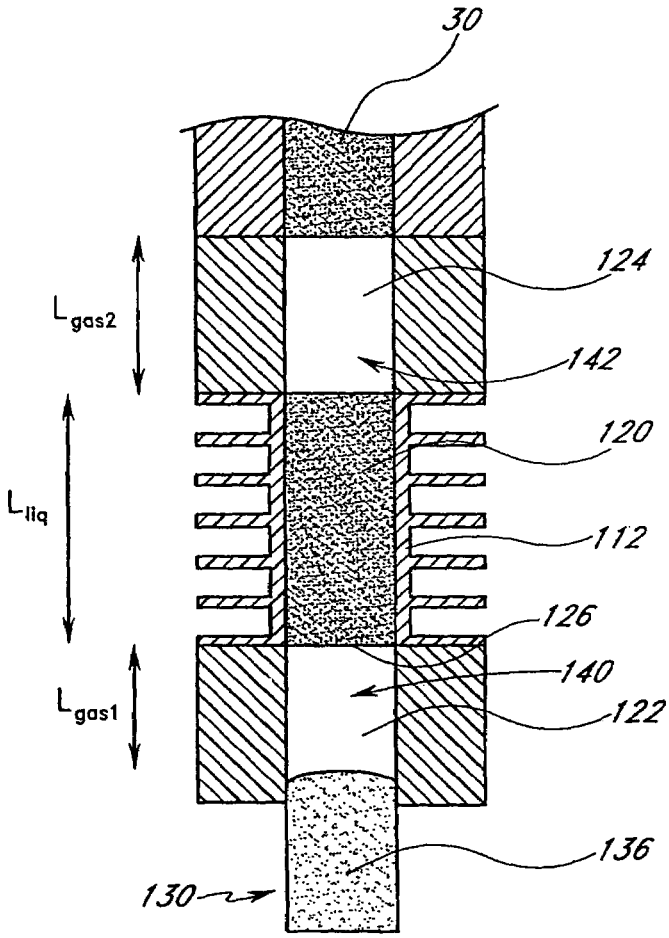
FIG. 7A schematically illustrates an embodiment of the engine in isolation.

FIG. 7A schematically illustrates the engine 100 in isolation. The source 130 includes an optical fiber 136 which seals the proximal end of the proximal volume 122. The resulting affinity of the central part 112 of the chamber wall to the liquid mass 120 creates the proximal volume 122 and the distal volume 124 on the proximal and distal sides of the liquid mass 120, respectively. The proximal volume 122 and distal volume 124 preferably serve as gas springs which are coupled to the liquid mass 120 and provide oscillatory restoring forces to the liquid mass 120 in response to displacements thereof. By selecting the type of gases present in the proximal volume 122 and distal volume 124, the effective spring constants of the gas springs can be selected to be linear (or close thereto) or non-linear. In certain embodiments, the gas in at least one of the volumes 122, 124 preferably includes air, while in other embodiments, the gas preferably includes a vapor form of the liquid that forms the liquid mass 120. The electromagnetic energy passes from the source 130 through the gas of the proximal volume 122 and interacts with the liquid mass 120. Consequently, it is preferable that the gas or vapor within the proximal volume 122 be substantially transparent to at least a portion of the electromagnetic radiation from the source 130.

In certain embodiments, the volume of the proximal volume 122 is on the same order of magnitude as the volume of the liquid mass 120. In the illustrated embodiment, the proximal volume 122 has a diameter of about 0.1 to 0.2 millimeters and a length of about 0.1 to 0.2 millimeters.

Figure 7B:
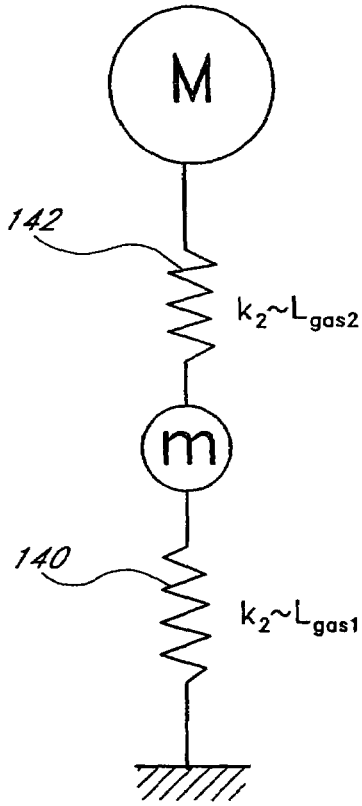
FIG. 7B schematically illustrates a conceptual model of the liquid mass as a mass M positioned between and coupled to a pair of springs.

The inertia of the liquid mass 120 and the compression of the gas springs of the proximal volume 122 and distal volume 124 constitute the typical components of an oscillator possessing a well-defined natural frequency and being capable of operating at resonance if excited at an appropriate frequency. Consequently, the liquid mass 120 can be conceptually modeled as a mass M positioned between and coupled to a pair of pre-load springs 140, 142, as schematically illustrated in FIG. 7B. The two springs 140, 142 have respective spring constants of $k_1$, and $k_2$, and with the distal spring 142 coupled to the mass M of the ink 30 within the ink cell 20. This oscillator thus will have a natural frequency ($f_n$) which can be approximated by equation 1:

$$f_n = \frac{1}{2\pi}\sqrt{\left(\frac{P_o}{L_{liq}\rho}\right)\left(\frac{L_{gas}}{L_{gas1}L_{gas2}}\right)} \quad [1]$$

where:

$P_o$ is the system average pressure;

$L_{liq}$ is the length of the liquid mass 120;

$\rho$ is the density of the liquid mass 120;

$L_{gas}$ is the combined length of the two gas springs 140, 142;

$L_{gas1}$ is the length of proximal gas spring 140;

$L_{gas2}$ is the length of the distal gas spring 142;

and the mass M of the ink 30 within the ink cell 20 is approximated to be much larger than the mass M of the liquid mass 120. The system average pressure is dependent on the speed of explosive vaporization which propels the liquid mass 120, as described more fully below.

While the illustrated embodiment uses a distal gas spring 142 disposed on the distal side of the liquid mass 120, other types of spring mechanisms are compatible with embodiments described herein. For example, the distal spring can comprise an elastic diaphragm used in conjunction with the distal gas spring 142 or used in lieu of the distal gas spring 142, as mentioned above.

Figure 8:
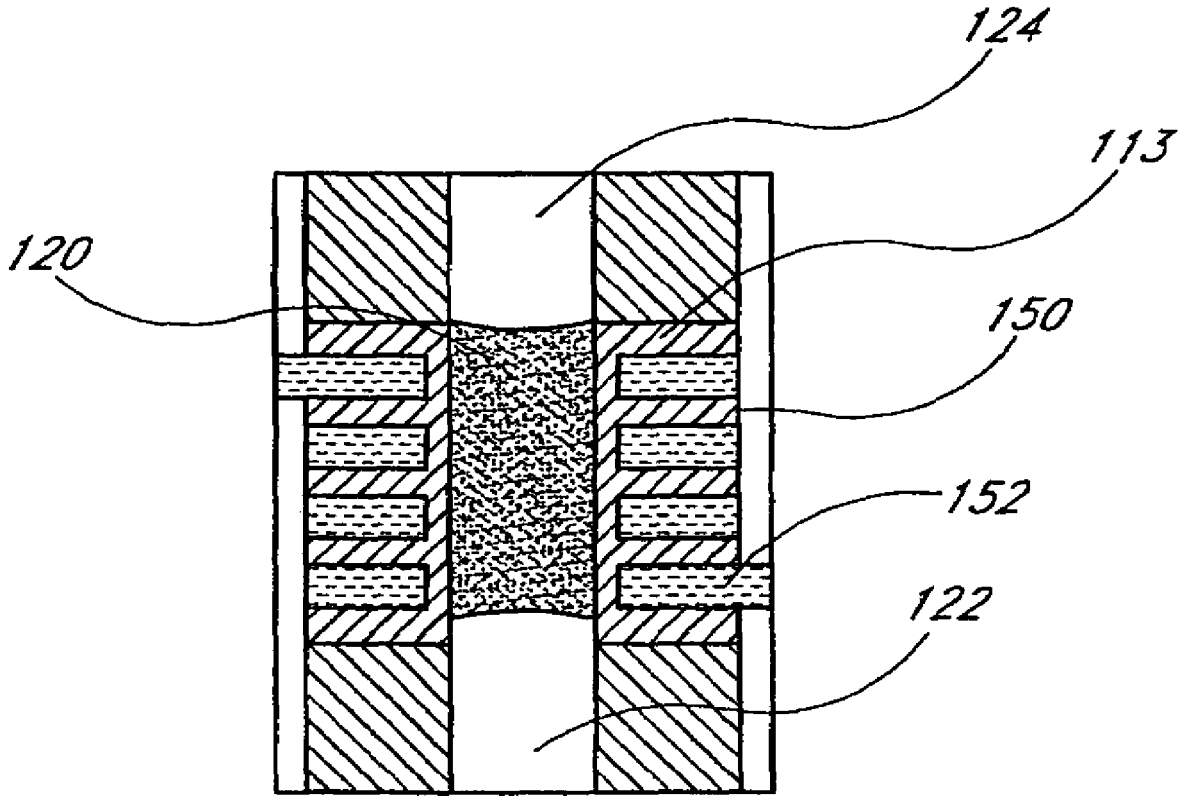
FIG. 8 schematically illustrates an embodiment of the engine which includes a cooling jacket.

As schematically illustrated by FIG. 8, the engine 100 also preferably comprises a cooling system that includes a cooling jacket 150 to cool at least the central engine housing 113 by removing heat generated by the interaction of the liquid mass 120 with the electromagnetic radiation from the source 130. In the illustrated embodiment, the cooling jacket 150 includes a one or more microchannels 152 cut into the central engine housing 113, preferably using an etching technique. The cooling jacket 150 receives coolant (e.g., water, air, or the ink itself) which removes heat from at least the central engine housing 113. To further facilitate removal of heat from the engine 100, the central engine housing 113 is preferably formed of a material having a relatively high heat transfer coefficient. The cooling jacket 150 preferably keeps the temperature of the liquid mass 120 below the boiling temperature. In certain embodiments, the cooling jacket 150 is preferably adapted to remove approximately 250 mW from a single engine. Of course, the cooling system can be adapted to remove more heat where the ink ejecting apparatus includes more than one engine. In other embodiments, the cooling system can comprise heat pipes (either in combination with or in the alternative to a cooling jacket) to remove heat from the engine 100. Such heat pipes are currently used in the field of plastic extrusion systems and high end printers.

With reference to FIG. 7A again, the source 130 provides laser light energy pulses from a laser (not shown) via the optical fiber 136 to the free surface 126 at the proximal end of the liquid mass 120. For this purpose, embodiments of the optical fiber 136 can either include: (1) a focusing lens that focuses the laser light to a diameter substantially matching the diameter of the chamber 110 at a location near (but distal of) the proximal end of the chamber 110; or (2) a collimating lens that aligns the laser light emitted from the distal end of the optical fiber 136, which has a core diameter substantially equal to the diameter of the chamber 110. In this manner, the laser light is preferably directed to impinge and heat generally the entire area of the free surface 126 of the liquid mass 120 that faces the optical fiber 136.

The liquid mass 120 preferably absorbs sufficient laser energy to superheat (instantly vaporize) a portion of the liquid mass 120 to a depth of at least one-tenth of the wavelength of the laser light. The absorption characteristics of the material of the liquid mass 120 and the high energy density of the laser are such that the absorption results in the rapid formation of a superheated layer which converts the portion of the liquid mass 120 into gas. As the liquid is vaporized, further portions of the liquid mass 120 beneath are exposed to the laser light and the superheated layer effectively migrates further into the liquid mass 120 (analogous to the sparks of a burning fuse migrating along the length of the fuse). The migration of the superheated layer is extremely fast such that the vaporized portion of the liquid mass 120 rapidly increases the pressure within the proximal volume 122 in a manner akin to an explosion. While vaporization is rapid, the duration of vaporization is limited by the duration of the laser pulse. Accordingly, only a small fraction of the liquid mass 120 preferably is vaporized by any given laser pulse. The vaporized portion preferably represents between about 0.05% and 5% of the liquid mass 120 by volume, and more preferably between about 0.1% and 1% by volume. The remaining portion of the liquid mass 120 (still in liquid phase) is preferably sufficiently long to serve as a piston and to perform mechanical work (e.g., compress the gas in the distal volume 124). Typically, the length of the vaporized portion of the liquid mass 120 is on the order of microns or fractions of microns.

The liquid mass 120 preferably behaves generally as a "plug flow" with a defined boundary layer around its periphery. The thickness of the boundary layer will depend upon the liquid's density and viscosity and upon the oscillation frequency, as understood from the following equation:

$$\lambda = \sqrt{\frac{2\mu}{\omega\rho}} \quad [2]$$

where:

$\lambda$=thickness of boundary layer;

$\mu$=viscosity of the liquid;

$\omega=2\pi$ times the oscillation frequency (e.g., the natural frequency, $f_n$ (see Equation [1])); and $\rho$=density of the liquid mass 120.

The boundary layer in the illustrated embodiment has a thickness % on the order of fractions of microns. Consequently, the liquid mass 120 oscillates generally as a mass plug. In such embodiments, the boundary layer preferably serves to inhibit escape of vapor from either the proximal volume 122 or the distal volume 124 into other portions of the ink ejecting apparatus 18.

The explosion created by the rapid vaporization of a portion of the liquid mass 120 pushes the liquid mass 120 in the distal direction. The liquid mass 120 rebounds in response to the restoring force from the distal gas spring 142, moves in the proximal direction, rebounds again in response to the restoring force from the proximal gas spring 140, and then is driven in the distal direction again by re-firing the laser diode 6. With correct dimensional design and operational conditions (e.g., laser pulses synchronized with oscillations of the liquid mass 120), undesired losses due to vapor-liquid heating and to mass transfer through the liquid-vapor surfaces are preferably minimized, thereby maximizing the efficiency of the engine 100.

Figure 7C:
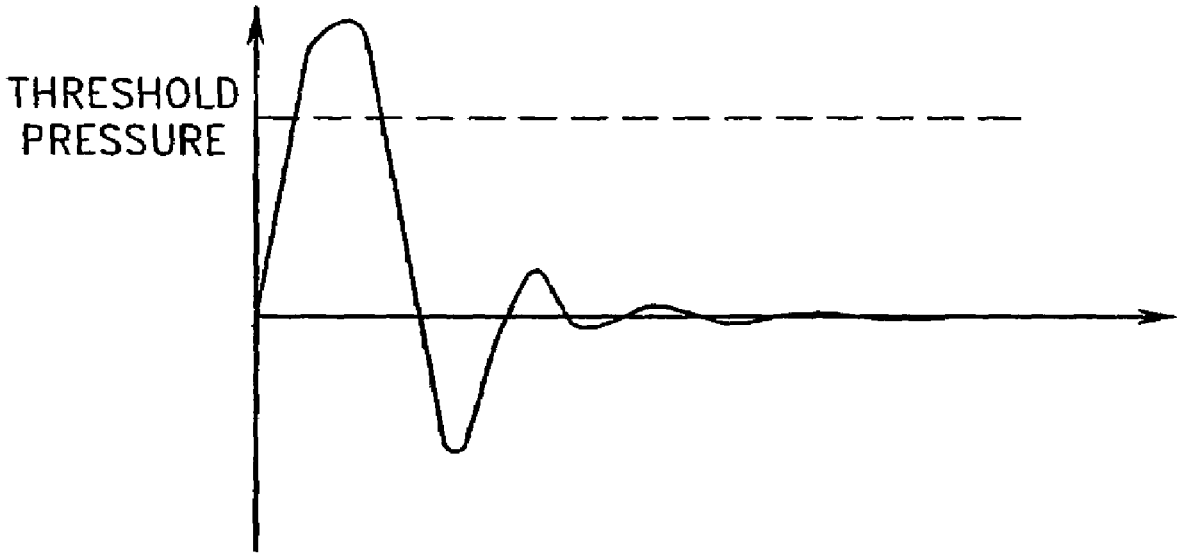
FIG. 7C schematically illustrates the displacement of the liquid mass in response to a pulse of electromagnetic energy.

FIG. 7C schematically illustrates the displacement of the liquid mass 120 in response to a pulse of electromagnetic energy from the source 130. Upon vaporization of a portion of the liquid mass 120, the remaining portion of the liquid mass 120 moves in the distal direction, reaching a maximal displacement. This maximal displacement is preferably sufficient to force some ink 30 out of the nozzle 40 of the ink cell 20 in the form of droplets. In FIG. 7C, the amount of displacement for the ejection of ink 30 from the nozzle 40 is denoted by a dashed line. In response to the restoring forces from the proximal volume 120 and the distal volume 124, as well as the energy losses of the apparatus (e.g., friction), the liquid mass 120 can be expressed as a damped harmonic oscillator. The magnitude of the distal displacement of the liquid mass 120 after the maximal displacement is preferably insufficient to eject ink 30 from the nozzle 40.

For embodiments utilizing multiple laser pulses, if the laser pulses are all at the same energy, the amplitude of the oscillations will start small and within a few oscillations (about 5 to 10) will reach a steady-state level of full amplitude. The exact number of oscillations to full amplitude is also influenced by the heat removal characteristics and other thermophysical characteristics of the apparatus 18. In the preferred embodiment, the power of the first laser pulse is higher (e.g., from 2 to 5 times greater) than the power of the following pulses, thus helping the apparatus 18 reach full scale oscillations quicker.

Figure 9A:
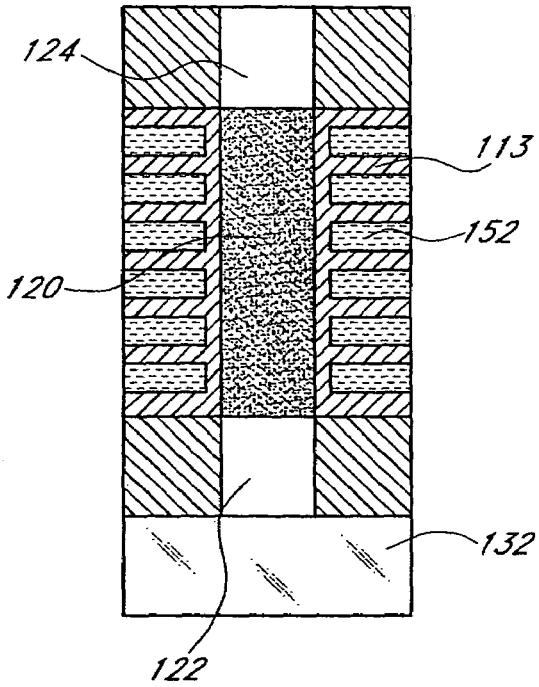
FIGS. 9A-9D schematically illustrate four sequential snapshots during the operation cycle of the engine.

The operation cycle of the engine 100 running at steady state can be further understood by examining FIGS. 9A-9D which schematically illustrate four sequential snapshots during the operation cycle of an embodiment of the engine 100. With reference to FIG. 9A, the liquid mass 120 is disposed at a generally central location within the chamber 110 and is moving proximally at this point in the cycle for reasons that will be soon apparent.

Figure 9B:
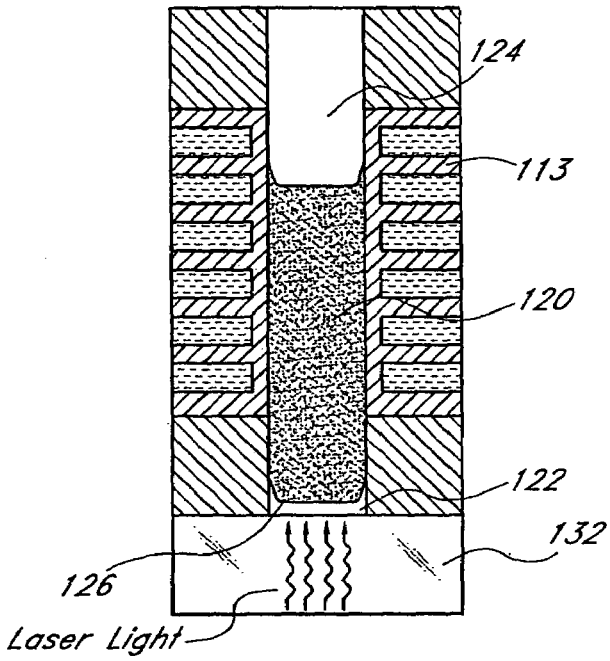

As seen in FIG. 9B, the laser diode 6 is preferably fired when the liquid mass 120 reaches its maximal displacement in the proximal direction. The laser light, which is delivered through the window 132, passes through the proximal volume 122. The laser light is preferably absorbed in the proximal free surface 126 of the liquid mass 120, which heats the liquid non-uniformly (i.e., the electromagnetic radiation superheats a layer of the liquid mass 120 without significantly heating the adjacent portion of the liquid mass 120). By radiatively heating the liquid mass at a heating rate above its critical heating limit (for an example, for water at atmospheric pressure, that limit is about 0.25 MW/g), at least substantially, if not all, of the heated portion of the liquid mass is brought to its superheat limit so as to boil instantaneously (i.e., explosively). That is, the heating of the layer of the liquid mass 120 is preferably too fast to allow normal boiling and about 5 microns of the proximal free surface 126 is vaporized by heating to the liquid superheat limit. In the illustrated embodiment, the vaporized layer preferably represents about 1% the volume of the liquid mass 120. In less than one microsecond, the vaporized layer preferably creates a large pressure rise in the proximal volume 122. The explosive bubble following superheating thus provides a propulsive force to move the unvaporized remainder of the liquid mass 120 in the distal direction.

Figure 9C:
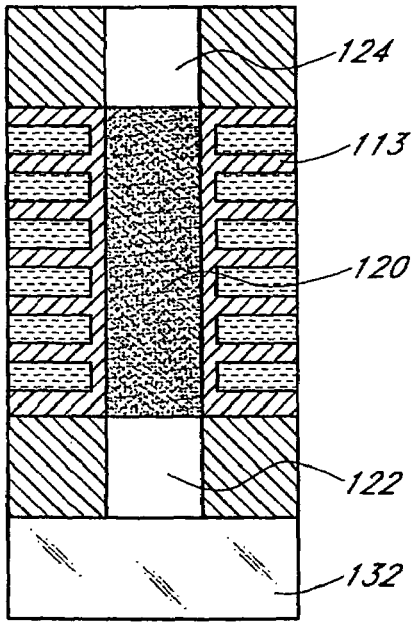

Under the action of the high pressure in the proximal volume 122, the liquid mass 120 starts moving distally, as seen in FIG. 9C. During the distal travel of the liquid mass 120 (as well as during its proximal travel), the liquid mass 120 preferably exhibits a plug flow profile with a defined boundary layer around the perimeter, as noted above. Cohesive forces (e.g., viscosity), as well as its colder temperature, preferably keep the liquid mass 120 as one continuous unit that generally moves as a monolith, thereby acting similarly to a solid piston.

Distal movement of the liquid mass 120 preferably compresses the vapor in the distal volume 124 adiabatically (similar to a conventional positive displacement vapor compressor). The increased pressure in the distal volume 124 works to reverse the distal movement of the liquid mass 120 and works to apply an impulse to the ink 30 in the ink cell 20. At least part of the kinetic energy of the moving liquid mass 120 is returned to the liquid mass 120 by elastic expansion of the distal volume 124, causing the liquid mass 120 to move in the proximal direction. The resultant restoring force from the distal volume 124 helps to push the liquid mass 120 toward its original position.

Figure 9D:
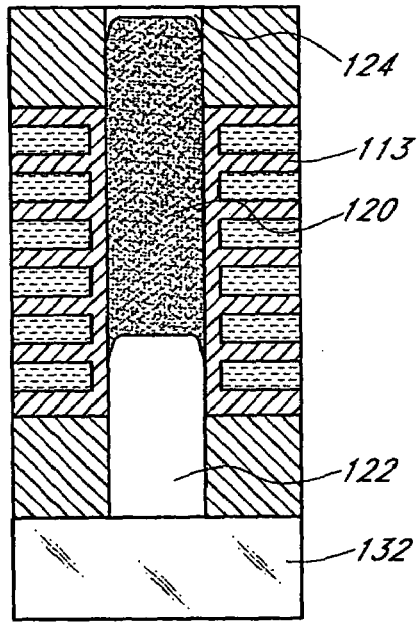

Additionally, once the liquid mass 120 has reached the point of its maximum displacement distally, as shown in FIG. 9D, the liquid mass 120 moves proximally. The work of expansion of the proximal volume 122 and the condensation of vapor on the wall of the cooled central engine housing 113 of the chamber 110 causes a pressure decrease which preferably also has the consequence of imparting velocity to (i.e., draws) the liquid mass 120 in the proximal direction. Due to the inertia of the liquid mass 120, however, the original position is overshot and the liquid mass 120 moves toward its maximum displacement in the proximal direction. The laser diode 6 once again is fired and the cycle repeats.

In the preferred embodiment, heat is actively removed from the engine 100 to maintain the body of the liquid mass 120 below its boiling point and to allow the explosively vaporized portion of the liquid mass 120 to return to the liquid state, serving as a reusable fuel for continued operation. As noted above, the central engine housing 113 of the chamber 110 is preferably formed from a material that is a good conductor of heat, so as to provide a heat sink. The heat sink, as schematically illustrated in FIGS. 7A and 8, is preferably constructed to have a large surface area and is preferably further cooled by a coolant (e.g., water, air, and/or the ink itself) that flows in or about the central engine housing 113. The coolant readily removes heat from the heat sink by forced convection. With water microchannels 152, as schematically illustrated in FIG. 8, forced convection can remove heat at 800 W/cm$^2$, permitting continual operation at high power with the cooling system removing the heat generated by the laser beam. Stable pressure oscillations are achieved when the total heat from the laser beam is balanced by the heat drawn out of the engine 100.

Radiation impinging onto a free surface of the liquid mass 120 results in non-uniform heating of the liquid mass 120. Vapor within volumes on each side of the liquid mass 120 function as gas springs to provide restoring forces, which enable the liquid mass 120 to enter a regime of steady state oscillations. In this way, embodiments of the ink ejecting apparatus 18 yield droplet formation frequencies at least as large as those of piezoelectric systems while having sizes comparable to those of thermal systems. In certain embodiments, the oscillation frequency is preferably greater than approximately 4 kHz, more preferably greater than approximately 75 kHz, and most preferably equal to approximately 500 kHz.

In addition, certain embodiments described herein utilize the fact that the ink ejecting apparatus 18 can be run at resonance, unlike prior thermal ink jet systems. While prior art systems typically have efficiencies of less than 1% (i.e., the kinetic energy of the ejected ink droplets is less than 1% of the thermal driving energy), embodiments described herein have overall efficiencies which are preferably between about 5%-15% by running at resonance. The energy of a single modulated laser pulse to excite the system from rest to eject a single ink droplet is typically greater than the energy needed to produce one ink droplet in a train of droplets. Thus, by producing trains of ink droplets by selectively timing the laser pulse excitations, embodiments described herein can produce droplets faster than many prior art systems.

Figure 10:
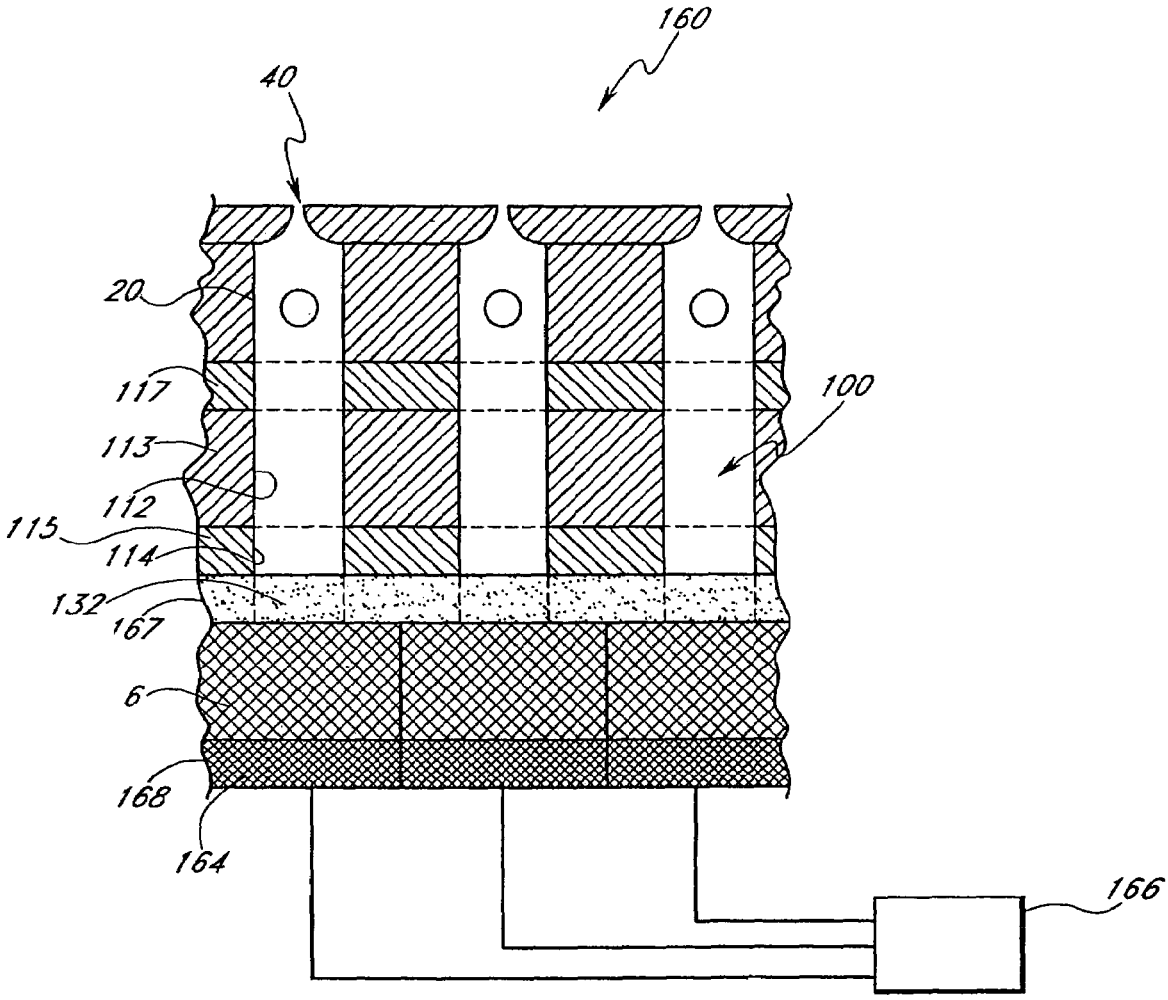
FIG. 10 schematically illustrates an exemplary printhead compatible with embodiments described herein.

FIG. 10 schematically illustrates an exemplary printhead 160 compatible with embodiments described herein. The printhead 160 comprises a plurality of nozzles 40, each of which is associated with a corresponding ink cell 20 and engine 100. The printhead 160 further comprises a plurality of laser diodes 6, with each laser diode 6 associated with a corresponding engine 100, and having a corresponding driver 164. The drivers 164 are coupled to and controlled by a printhead controller 166. The general construction of each engine 100 (including the laser diode) and each ink cell 20 preferably is in accordance with the above description.

As illustrated by FIG. 10, the plurality of nozzles 40 and the corresponding ink cells 20 and engines 100 are preferably fabricated as monolithic components on a semiconductor wafer. In such embodiments, the nozzles 40, ink cells 20, and engines 100 can be formed using lithography technology, which is used in the field of semiconductor integrated circuit fabrication.

The nozzles 40 of the printhead 160 are preferably between approximately 25 microns and approximately 75 microns in diameter, and more preferably approximately 50 microns in diameter. The nozzles 40 are also preferably spaced by approximately 100 microns to approximately 500 microns from one another. Typically, the printhead 160 comprises approximately 20 to 50 nozzles 40 arranged in a line or sets of parallel lines, with corresponding ink cells 20 and engines 100. In certain embodiments, the nozzles 40 can be placed within an area of approximately 12 millimeters by 1 millimeter.

In the exemplary embodiment of FIG. 10, a wafer 167 is used as a substrate for subsequent fabrication of the nozzles 40, ink cells 20, and engines 100. Advantageously, portions of the wafer 167 can serve as the windows 132 for the engines 100. In such embodiments, the wafer 167 is composed of a material substantially transparent to laser light from the plurality of laser diodes 6, as well as having sufficient structural integrity to withstand the numerous rapid vaporizations of the liquid mass 120. For infrared wavelengths (e.g., 770-980 nanometers), appropriate window materials include, but are not limited to, plastic, sapphire, quartz, and silica glass. Since the bubble does not completely collapse, liquid cavitation is inhibited so to preserve the reliability of the system.

As described above, the window 132 can additionally comprise one or more optical elements (e.g., focussing lenses, cylindrical lenses, anamorphic lenses, diffractive optics, reflective optics, etc.) to shape the laser beam (e.g., by focussing, collimating, or reducing astigmatism), thereby facilitating the propagation of the laser light to the liquid mass 120 of the corresponding engine 100. In addition, the thickness of the window 132 can be selected to impart sufficient divergence of the laser beam to irradiate a desired portion of the proximal free surface 126 of the liquid mass 120.

The nozzles 40, ink cells 20, and engines 100 of the exemplary embodiment of FIG. 10 can be fabricated on the wafer 167 by judicious selection of materials and lithography process steps. For example, the proximal engine housing 115 of each engine 100 can be formed by depositing a first layer of material which has a low affinity for the liquid mass 120, and etching away material to form the proximal volume 122 of each engine 100. Alternatively, the inner surface 114 of the proximal volume 122 can be coated with an appropriate material to provide the low affinity surface. Similarly, the central engine housing 113 can be fabricated on the proximal engine housing layer 115, using either a material with a high affinity for the liquid mass, or an appropriate coating on the inside surface 112 of the etched chamber. The remaining distal engine housings 117, ink cells 20, and nozzles 40 can be similarly fabricated by subsequent lithography processes in like manner. The resulting ink cells 20 are preferably approximately 100 microns to 300 microns in diameter.

The plurality of laser diodes 6 can be fabricated using semiconductor lithography technology. The laser diodes preferably comprise multiple heterojunction layers of III-V materials, (e.g., GaAlAs—GaAs heterojunction layers, which provide laser light with a wavelength between approximately 770 nanometers and approximately 980 nanometers), but other materials may be used. Such III-V heterojunction laser diodes are typically small, reliable, and inexpensive, thereby being compatible with embodiments described herein. The laser diodes preferably comprise electrical connections (e.g., metallization, doped semiconductor regions) fabricated by lithography and etching techniques for electrical signals to propagate from the drivers.

The laser diodes 6 preferably each have a profile of about 100 microns by 1 micron, with the laser light emitted from the short side of the laser diode 6 in a direction generally parallel to the heterojunction layers. Alternatively, in certain embodiments, vertical cavity surface emitting laser (VCSEL) diodes can be used as discussed above. VCSELs which emit laser light from the surface of the laser diode 6 in a direction generally perpendicular to the heterojunction layers. Exemplary laser diodes compatible with embodiments described herein are described by U.S. Pat. No. 5,219,785 issued to Welch et al., which is incorporated in its entirety by reference herein.

As described above, laser diodes 6 typically include an active region from which the laser light is emitted, and cladding layers which guide the light within the active region, The physical properties (e.g., thickness, composition, refractive index, and doping or conductivity) of the various layers, including the cladding layer, can be selected so as to tailor the laser diode output. For example, by judicious selection of the thickness and refractive index of the cladding layers of the laser diode 6, the output laser beam width can be sized to illuminate a selected portion of the proximal free surface 126 of the liquid mass 120. As described above, the window 132 can comprise optical elements also to shape the laser beam. Alternatively, the laser diode 6 can comprise such optical elements, or the optical elements can be distributed among the window 132 and the laser diode 6.

In the exemplary embodiment of FIG. 10, the plurality of laser diodes 6 are formed on a wafer 168, which advantageously also serves as a substrate for the electronic circuitry of the drivers 164 for the laser diodes 6. In other embodiments, the laser diodes 6 are formed on a substrate which is bonded to the substrate, for example, using flip-chip bonding. In still other embodiments, the laser diodes 6 can be formed separately and mounted onto the substrate for the drivers 164, thereby reducing the problems associated with production yield of arrays of laser diodes 6.

Coupling the laser diodes 6 to the engines 100 can be achieved by various technologies, including but not limited to, butt coupling. The laser diode 6 corresponding to each engine 100 is positioned so that at least a portion of the laser light emitted by the laser diode 6 propagates into the engine 100 through the window 132 and impinges the liquid mass 120.

The drivers 164 are electrically coupled to the laser diodes 6 and provide the voltages and currents to operate the laser diodes 6. The controller 166 is electrically coupled to the drivers 164 and supplies control signals to the drivers 164. The controller 166, drivers 164, and laser diodes 6 are preferably configured so that the laser diodes 6 are individually addressable (i.e., the individual nozzles 40 can be fired independently from one another) in response to the control signals from the controller 166.

While the embodiment illustrated in FIG. 10 employs laser diodes 6 disposed adjacent to the engine chamber 110, the laser diodes 6 can be remotely disposed, as explained above in connection with FIGS. 4A and 4B. In such an embodiment, a plurality of optical fibers preferably delivers laser light from the laser diodes 6 to the engine chambers. In this manner, a portion of the engine 100 (e.g., the chamber 110) and the ink cell 20 travel with the printhead carriage, while the laser diode array remains stationary.

Figure 11:
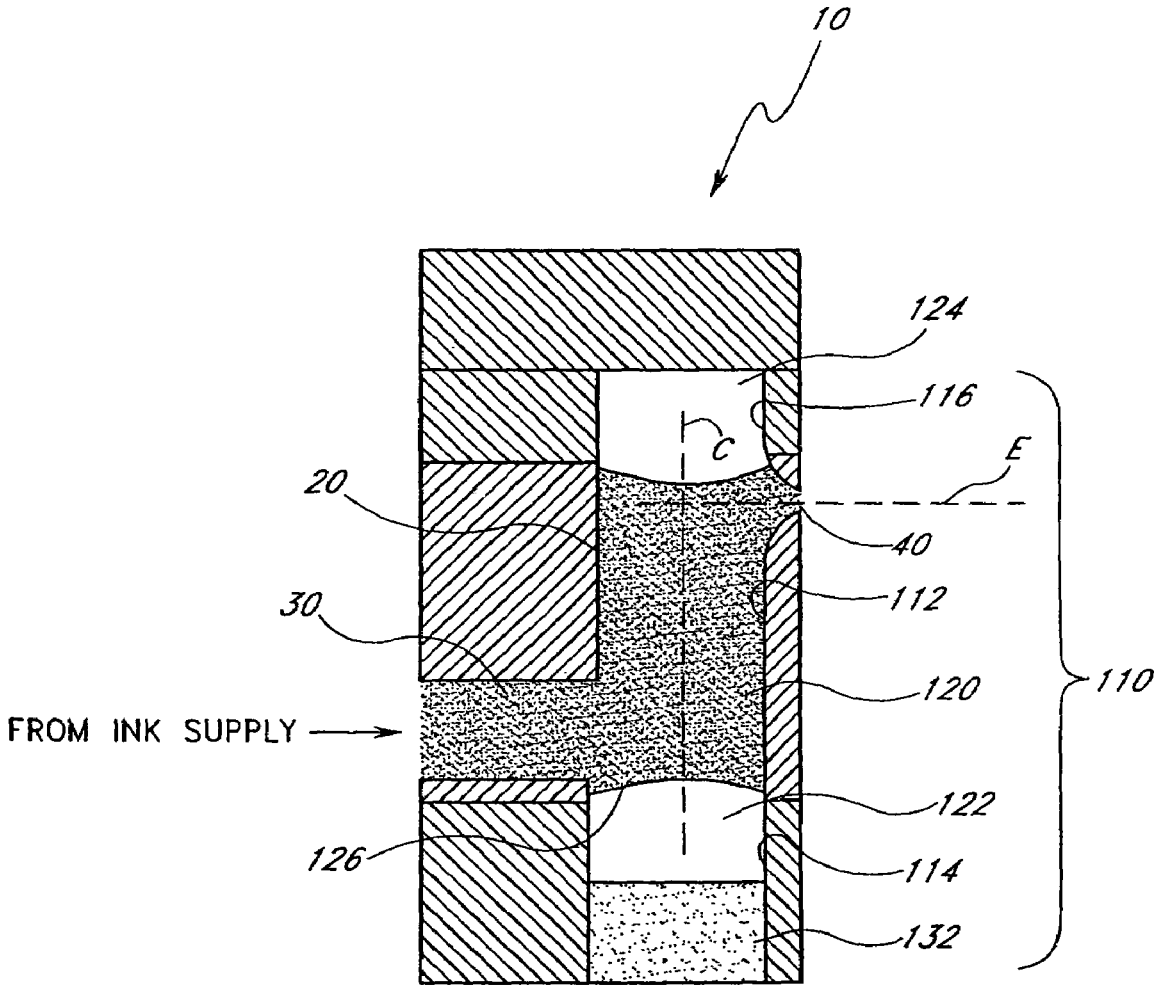
FIG. 11 schematically illustrates an embodiment of the ink ejecting apparatus in which the liquid mass of the engine comprises the ink that is to be ejected through the nozzle of the apparatus.

FIG. 11 schematically illustrates another embodiment of the ink ejecting apparatus 18 in which the ink 30 within the ink cell 20 also serves as the liquid mass 120 and the ink cell 20 also serves as the chamber 110 of the engine 100. In other words, the liquid mass 120 of the engine 100 and the ink 30 of the ink cell 20 comprise a single body of ink. As described above, the integrity of the liquid mass 120 is preferably maintained by adapting the central part 112 of the chamber wall to have a high affinity for the ink 30 and adapting the proximal part 114 and distal part 116 of the chamber wall to have a low affinity for the ink 30. The chamber 110 also comprises the proximal volume 122 of vapor and the distal volume 124 of vapor which serve as gas springs, as described above. The proximal volume 122 is defined on one side by the proximal free surface 126 of the liquid mass 120 and on the opposite side by a window 132 which transmits at least a portion of the electromagnetic energy from a laser (not shown) or another electromagnetic wave source (e.g., a laser diode). Of course, other electromagnetic sources 130 (e.g., electrical discharge) can also be used.

Upon introducing a laser pulse from the laser to impinge and vaporize a portion of the liquid mass 120, the remaining portion of the liquid mass 120 is propelled in the distal direction. The resulting impulse ejects some of the ink 30 of the liquid mass 120 out of the nozzle 40. The lost ink 30 is preferably replenished by ink 30 from the ink reservoir 4.

As seen in FIG. 11, both the nozzle 40 and the ink reservoir 4 in the illustrated embodiment communicate with the chamber 110 at points disposed on the central part of the chamber 110. Thus, at least during a portion of the oscillation period, the ink reservoir 4 communicates with the liquid mass 120 (which also constitutes the ink 30 in the ink cell 20 in this embodiment) and the nozzle 40 communicates with the liquid mass 120. The points of communication, however, preferably are not exposed to the vapor within the proximal and distal volumes 122, 124. Due to the high affinity of the central part 113 of the chamber 110, a boundary layer of fluid is formed over the surface as the liquid mass 120 reciprocates. Thus, the portion of the liquid adjacent the wall of the central portion 113 remains generally fixed as the central portion of the liquid moves as a slug, as noted above. The liquid boundary thus inhibits vapor influx into the nozzle 40 and into the conduit connecting the ink reservoir 4 to the chamber 110.

The ejection axis E of the nozzle 40 in this embodiment lies generally normal to the central axis C of the chamber 110 in the illustrated embodiment. Similarly, an axis of the conduit that connects the ink reservoir 4 to the chamber 110 also lies generally normal the central axis C of the chamber 110. In other embodiment, these axes can be skewed relative to the chamber central axis C.

Figure 12:
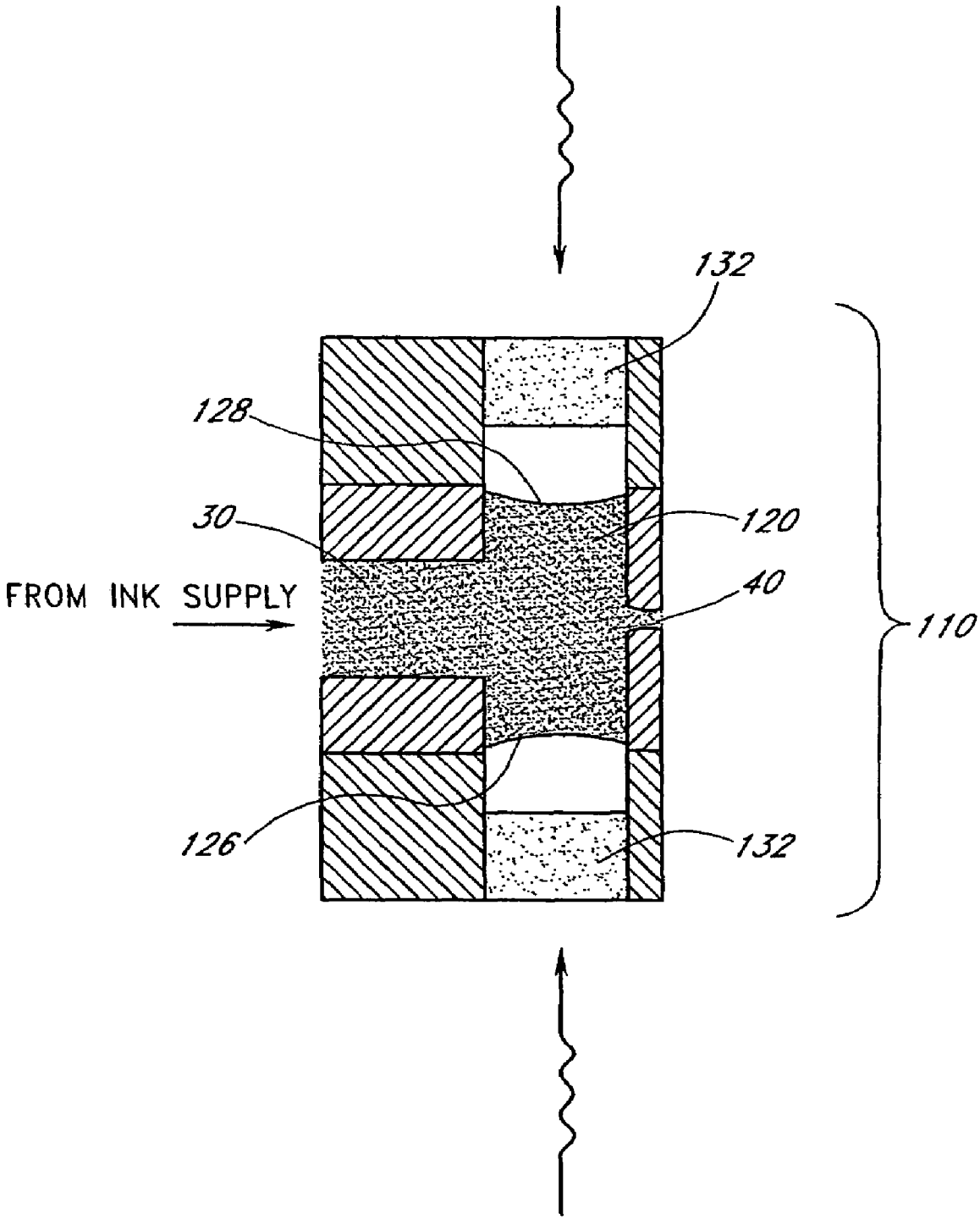
FIG. 12 schematically illustrates an embodiment of the ink ejecting apparatus with a pair of windows on opposite sides of the chamber.

FIG. 12 schematically illustrates an additional embodiment of the ink ejecting apparatus 18 similar to that of FIG. 11, but with the source 130 comprising a pair of windows 132 on opposite ends of the chamber 110. In such embodiments, electromagnetic energy from the source 130 can be directed to impinge both the proximal free surface 126 of the liquid mass 120 and the distal free surface 128 of the liquid mass 120. In certain embodiments, the source 130 comprises two separate lasers, one for each end of the liquid mass 120. In other embodiments, a single laser is used in conjunction with optical fibers and a switch to provide electromagnetic energy from the laser to both ends of the liquid mass 120.

The laser pulses at each end of the chamber 110 are preferably timed to impinge the liquid mass 120 at its position of maximal displacement toward the respective end of the chamber 110. In this way, such embodiments preferably allow higher speed and efficiency, and are easier to control.

In another mode of operation, the laser pulses at each end of the chamber 110 can be timed so as generally to simultaneously impinge upon the liquid mass 120 to "push" on each end of the liquid mass 120. In this embodiment, one or more gas chambers preferably are provided so as to allow a portion of the liquid mass 120 to move in a direction other than in a direction parallel to an axis of light propagation from the two sources 130. For example, an annular gas spring chamber can be provided, such as the type illustrated in FIG. 13 and described below. In another form, one or more gas spring chambers can extend normal to the propagation axes.

Figure 13:
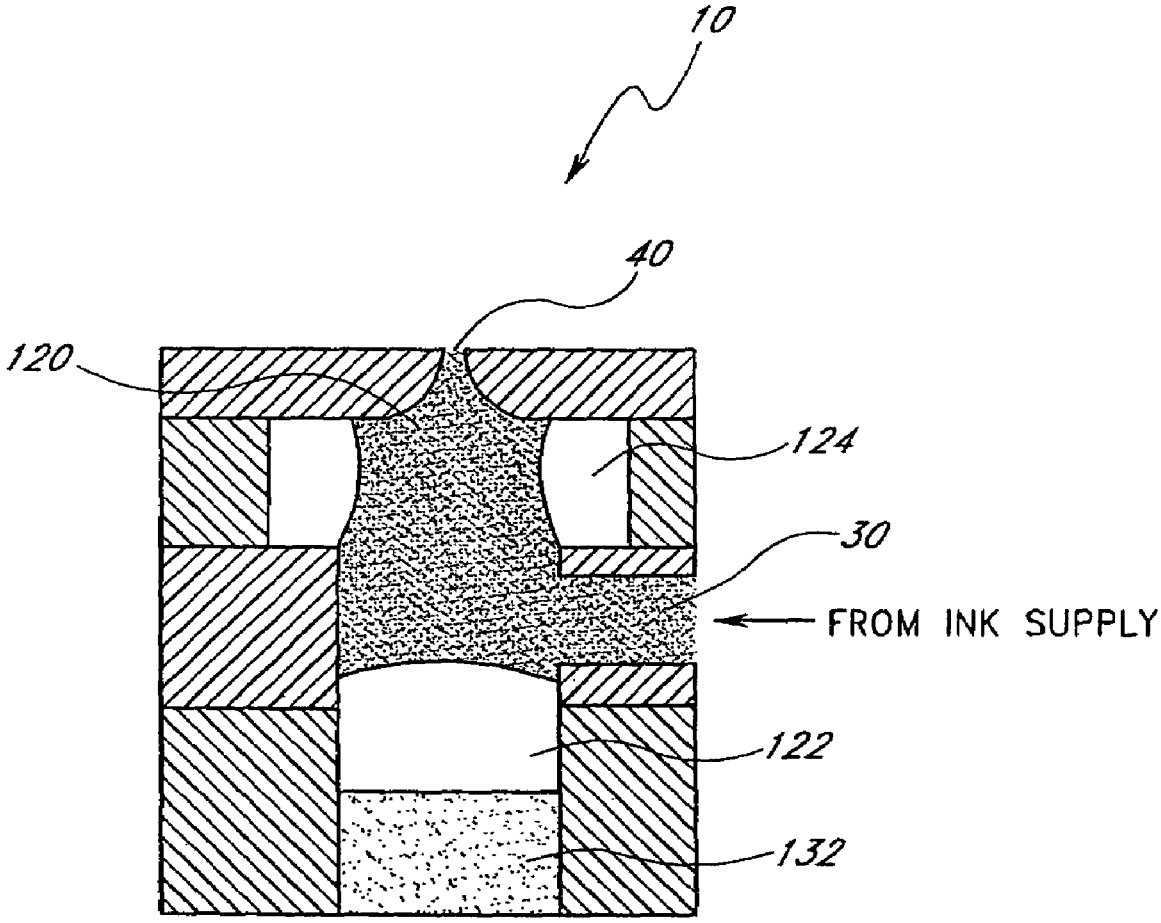
FIG. 13 schematically illustrates an embodiment of the ink ejecting apparatus in which a vapor volume has a generally annular shape.

FIG. 13 schematically illustrates an embodiment of the ink ejecting apparatus 18 in which the distal volume 124 has a generally annular shape. In such embodiments, laser pulses transmitted through the window 132 and impinge and vaporize a portion of the ink 30 of the liquid mass 120, preferably ejecting some of the ink 30 out of the nozzle 40. In addition, the liquid mass 120 is propelled into the annular distal volume 124, compressing the vapor therein. After reaching its maximal displacement into the annular distal volume 124, the liquid mass 120 rebounds back towards the proximal volume 122 due to the restoring force from the compressed vapor in the annular distal volume 124.

Figure 14:
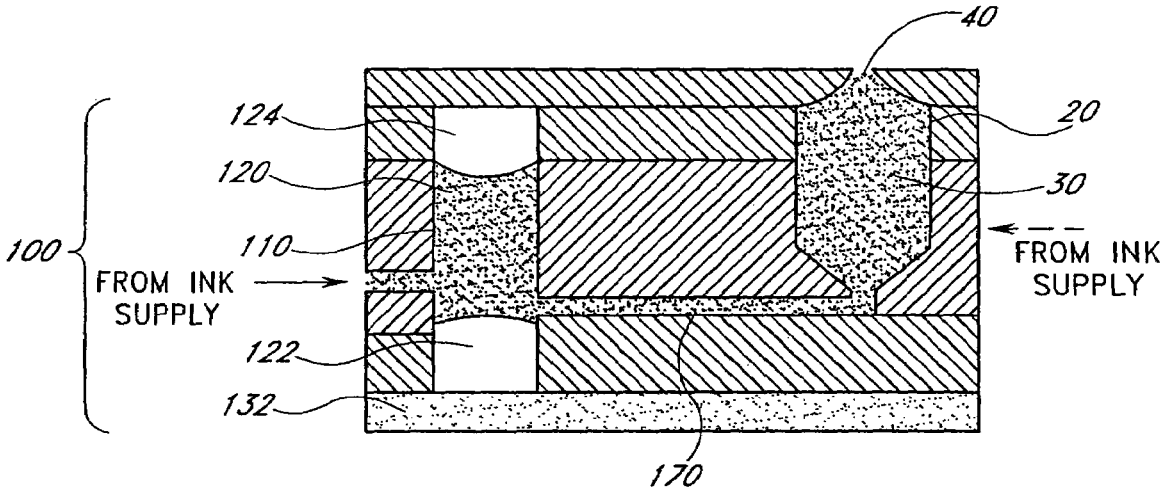
FIG. 14 schematically illustrates an embodiment of the ink ejecting apparatus in which the ink cell is coupled to the engine by a coupling duct.

FIG. 14 schematically illustrates an embodiment of the ink ejecting apparatus 18 in which the ink cell 20 is coupled to the engine 100 by a coupling duct 170. In certain embodiments, the length of the coupling duct 170 is adapted for maximal conversion of the engine pressure to ink displacement. The coupling duct 170 preferably translates a high pressure pulse to a low pressure high displacement pulse. The preferred length of the coupling duct 170 is dictated by thermoacoustic consideration, and is preferably approximately one-fourth the acoustic wavelength of the ink 30. The relevant thermoacoustics are described more fully by G. W. Swift in "Thermoacoustics: A Unifying Perspective for Some Engines and Refrigerators," Acoustical Society of America, 2002, which is incorporated in its entirety by reference herein. In an exemplary embodiment utilizing a water-based ink 30, the speed of sound is about 1500 meters/second and for operation at about 500,000 ink droplets per second out of the nozzle 40, the coupling duct 170 is preferably about 0.75 millimeters in length. In certain such embodiments, the average pressure within the engine 100 is on the order of 100 atmospheres while the pressure within the ink cell 20 is on the order of 10 atmospheres, depending on nozzle design.

In certain embodiments, the material of the walls of the coupling duct 170 is preferably selected to facilitate the conversion of engine pressure to ink displacement. To reduce losses of acoustic energy through the walls of the coupling duct 170, the material is preferably selected to have a different density and compressibility than the ink 30. Exemplary materials compatible with embodiments described herein include, but are not limited to tungsten.

Figure 15A:
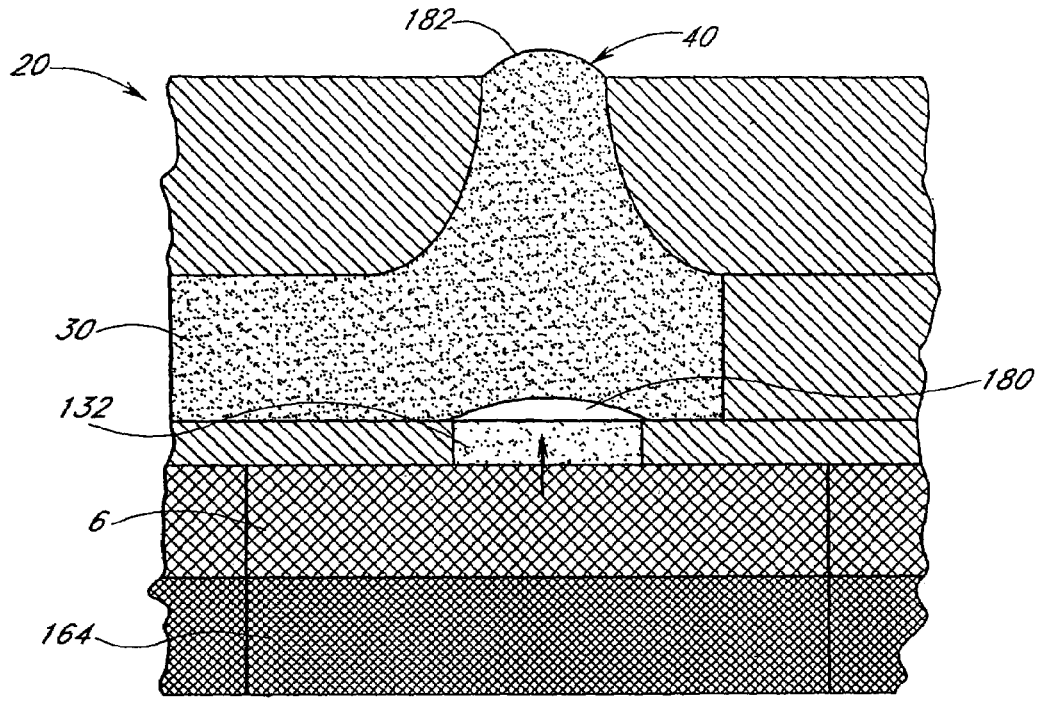
FIGS. 15A through 15D schematically illustrate sequential operational states of an embodiment of the ink ejecting apparatus in which a source of laser light is optically coupled to the ink within the ink cell.

FIG. 15A illustrates another embodiment of the ink ejecting apparatus 18 in which the source of laser light (e.g., a laser diode 6) is optically coupled to the ink 30 within the ink cell 20. In this embodiment, a vapor bubble temporarily forms between a window 132 and the ink 30 rather than being predisposed therebetween. For this purpose, the window 132 opens directly into the ink cell 20, which normally fills with ink 30 from an ink source (e.g., ink reservoir 4 when the laser light source is inactive).

The ink cell 20 generally has a conventional construction. The window 132, however, replaces the conventional thermal resistive heater. While in the illustrated embodiment the window 132 lies directly across the cavity from the nozzle 40, the window 132 can lie in other orientations relative to the nozzle 40. For example, the window 132 and the source of laser light 130 can be arranged such that an axis of light propagation extends generally normal to the ejection axis of the nozzle 40.

In the illustrated embodiment, the source 130 of laser light is a laser diode 6 that is optically coupled to the ink cell 20 through the window 132. As noted above, the window 132 and possible other optical elements, shape and focus the light so as to produce a desired beam size and shape at a location within the ink cell 20 just on the other side of the window 132. Additionally, the laser diode 6 can be disposed adjacent to the ink cell 20 or can be disposed remotely and coupled with the ink cell 20 through a suitable waveguide (e.g., optical fiber).

The window 132, laser diode 6 and nozzle 40 preferably are as described above in connection with the embodiment illustrated in FIGS. 6A and 6B. Additionally, the ink cell 20 communicates with a supply of ink 30 and has a size preferably no larger than generally 1 cubic millimeter. The variations described above can also be incorporated into the present embodiment. For example, the laser diode 6 can be incorporated into a replaceable cartridge or can be more permanently mounted within the printer (either on the movable carriage or fixed to the housing). Additionally, the cell 20 can be formed using conventional techniques, including lithography, as described above.

The laser diode 6 preferably emits a modulated train of light pulses. The first pulse passes through the window 132 and superheats a volume of ink that occupies a space next to the window 132. The superheated ink explosively boils, as described above, and vaporizes to form a bubble 180. The bubble 180 expands rapidly to an extent limited by the amount of laser energy. The bubble 180 then begins to collapse (i.e., implode). The formation of the bubble 180, however, imparts momentum to the liquid ink which moves the ink toward the nozzle 40. Ink ejects through the nozzle 40 as a result of the movement. The laser diode 6 supplies a second pulse of laser light which is absorbed by the ink 30 before the bubble 180 completely collapses (e.g., before the ink 30 returns to contact the portion of the window 132 which delivers the laser light).

FIGS. 15A-15D together illustrate a preferred operation of the present ink ejecting apparatus 18 once the apparatus 18 has begun to operate (e.g., after the first modulated pulse of laser energy has been delivered). FIG. 15A shows the vapor bubble 180 collapsed to an extent where a liquid-vapor interface of the bubble 180 lies near, but not contiguous to, the portion of the window 132 through which the laser light shines into the ink cell 20. The meniscus 182 of the ink 30 extends outward from the nozzle 40 due to the positive pressure of the ink 30 relative to atmospheric pressure.

Figure 15B:
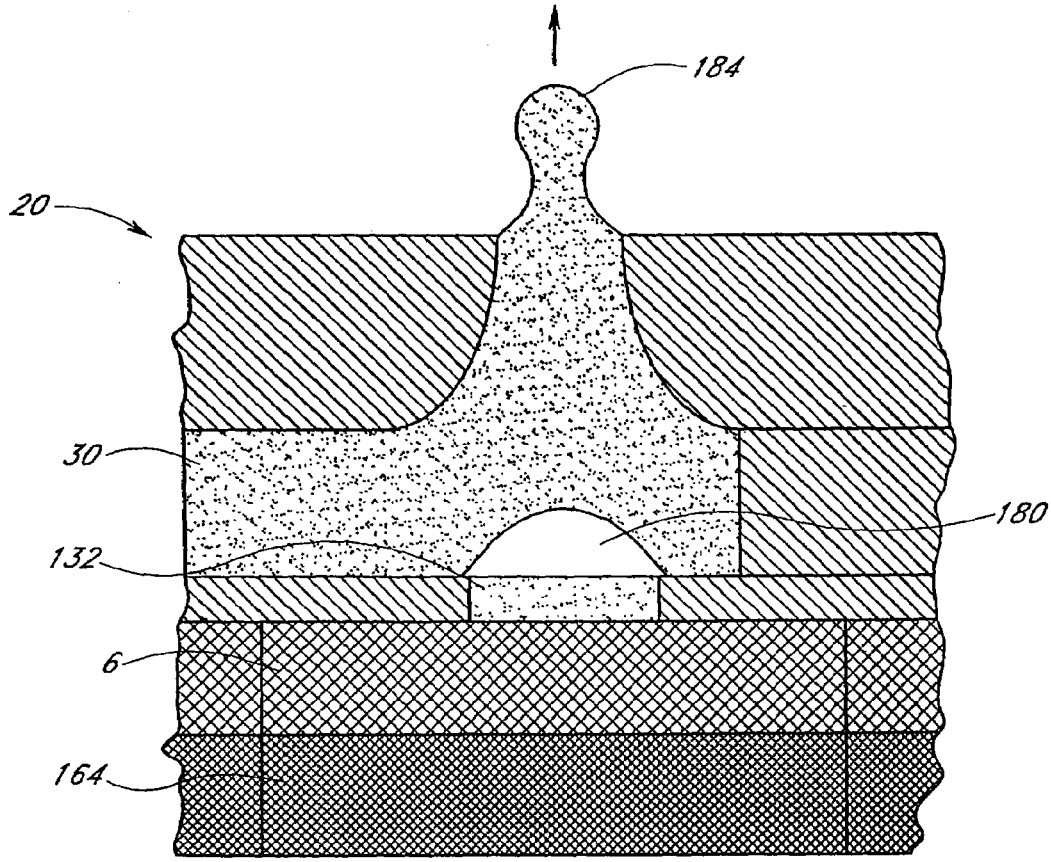
Figure 15C:
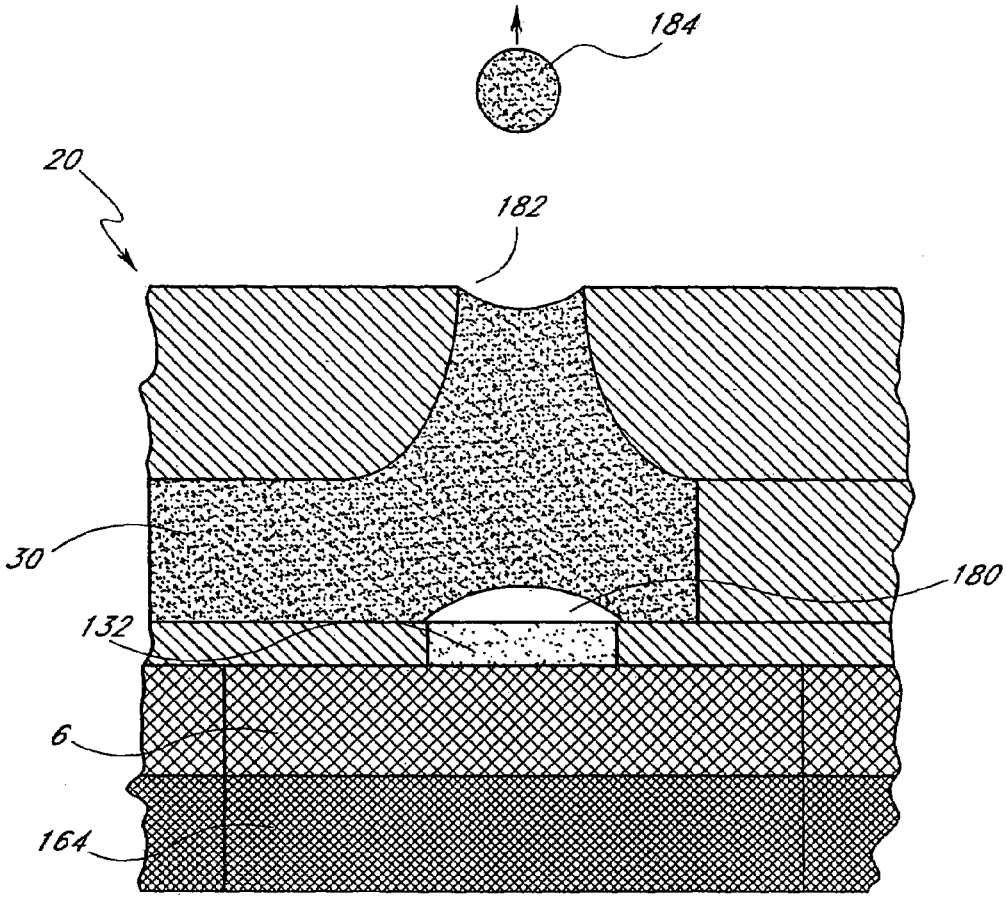

At this point, the laser diode 6 supplies a second (or subsequent) laser light pulse. FIG. 15B shows a preferred result of this laser pulse on the ink 30 in the ink cell 20. The ink 30 absorbs a significant portion of the energy and explosively boils to rapidly expand the bubble 180. The rapidly expanding vapor bubble 180 forces ink 30 out of the nozzle 40, thereby forming an ink droplet 184 having momentum away from the nozzle 40. Once the ink droplet 184 detaches from the ink 30, the meniscus 182 recoils back into the ink cell 20, as shown in FIG. 15C, and the vapor bubble 180 begins to collapse.

Figure 15D:
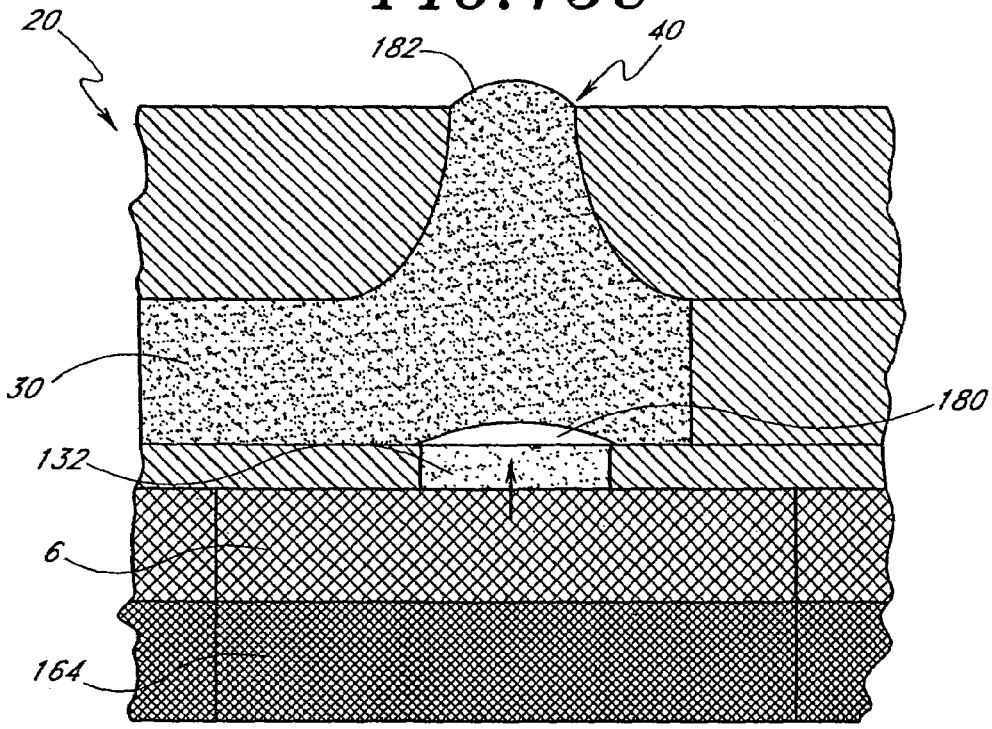

The collapse of the vapor bubble 180 can be attributed to the positive pressure of the ink 30 and to a reflected acoustic wave generated by the rapid expansion of the vapor bubble 180 earlier. In addition, the meniscus 182 returns towards its initial position, as shown in FIG. 15D. The positive pressure of the ink 30 preferably results in ink flowing into the cell 20 from an ink supply (e.g., ink reservoir 4) so as generally to refill the ink cell 20 before the laser diode 6 supplies the next laser pulse. The next pulse, as well as all subsequent pulses in the modulated pulse train, are preferably delivered before the bubble 180 completely collapses.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In particular, while the present engine has been described in the context of particularly preferred embodiments, the skilled artisan will appreciate, in view of the present disclosure, that certain advantages, features and aspects of the engine may be realized in a variety of other applications, many of which have been noted above. For example, while the apparatus and methods described herein are expressed in terms of printers, various embodiments, aspects and features are also compatible with copiers, fax machines, and other devices designed to provide images on a tangible medium. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims that follow.

What is claimed is:

1. An ink ejecting apparatus comprising:

a nozzle adapted to eject ink;

an ink cell containing ink and communicating with the nozzle; and an engine including a liquid mass, a source of electromagnetic energy energizing the liquid mass by exposing a portion of the liquid mass to electromagnetic energy, and a gas spring disposed within a propagation path of the electromagnetic energy, the engine arranged such that movement of the liquid mass is at least partially transmitted to the ink within the ink cell to eject ink through the nozzle.

2. The ink ejecting apparatus of claim 1, wherein the source of electromagnetic energy drives the liquid mass at a oscillation frequency.

3. The ink ejecting apparatus of claim 2, wherein the oscillation frequency is greater than approximately 4 kHz.

4. The ink ejecting apparatus of claim 3, wherein the oscillation frequency is greater than approximately 75 kHz.

5. The ink ejecting apparatus of claim 2, wherein the oscillation frequency is a natural frequency of oscillation of the liquid mass in a chamber of the engine, and the source of electromagnetic energy is adapted to deliver pulses of electromagnetic energy to the liquid mass at a frequency substantially equal to the natural frequency.

6. The ink ejecting apparatus of claim 1, wherein the ink cell is coupled to an ink reservoir containing ink, whereby the ink reservoir supplies the ink cell with ink.

7. The ink ejecting apparatus of claim 1, wherein the liquid mass of the engine is at least periodically in fluidic communication with the ink within the ink cell.

8. The ink ejecting apparatus of claim 1, wherein a coupling duct at least periodically connects together the liquid mass of the engine and the ink within the ink cell.

9. The ink ejecting apparatus of claim 1, wherein the nozzle communicates with the liquid mass.

10. The ink ejecting apparatus of claim 9 additionally comprising a supply conduit that at least selectively supplies ink to the liquid mass from an ink reservoir.

11. The ink ejecting apparatus of claim 1, wherein the nozzle has a diameter of approximately 25 microns.

12. The ink ejecting apparatus of claim 1, wherein the nozzle has an ejection axis, and the engine is arranged such that an axis of the propagation path is substantially collinear with the ejection axis of the nozzle.

13. The ink ejecting apparatus of claim 1, wherein the nozzle has an ejection axis, and the engine is arranged such that an axis of the propagation path is substantially normal to the ejection axis of the nozzle.

14. The ink ejecting apparatus of claim 1 additionally comprising a second gas spring positioned on a second side of the liquid mass generally opposite from a side on which the first gas spring is disposed.

15. The ink ejecting apparatus of claim 14 additionally comprising an ink cell that contains ink and that communicates with the nozzle, and the second gas spring arranged between the ink within the ink cell and the liquid mass of the engine.

16. The ink ejecting apparatus of claim 14, wherein the source of electromagnetic energy drives the liquid mass at a oscillation frequency, and the nozzle communicates with the liquid mass at a point between the gas springs during at least a portion of the oscillation period.

17. The ink ejecting apparatus of claim 14 additionally comprising a second source of electromagnetic energy that is arranged to energize the opposite side of the liquid mass by exposing the second side of the liquid mass to electromagnetic energy, the sources of electromagnetic energy cooperating so as to drive the liquid mass at a frequency.

18. The ink ejecting apparatus of claim 1, wherein the engine comprises a chamber that includes a variable volume of vapor positioned at least partially around a portion of the liquid mass, and said portion of the liquid mass is distanced from the gas spring.

19. The ink ejecting apparatus of claim 18, wherein the nozzle is disposed at an end of the chamber, the source of electromagnetic energy is disposed at an opposite end of the chamber, and the variable volume of vapor is located near the nozzle.

20. The ink ejecting apparatus of claim 1, wherein the engine comprises a chamber including:

a first end section having an inner surface with a low affinity for the liquid mass;

a second end section having an inner surface with a low affinity for the liquid mass;

an intermediate section between the first end section and the second end section, the intermediate section having an inner surface with a higher affinity for the liquid mass than do the inner surfaces of the first and second end sections.

21. The ink ejecting apparatus of claim 20, wherein the intermediate section is generally conductive to thermal energy, and the first and second end sections are less conductive to thermal energy than is the intermediate section.

22. The ink ejecting apparatus of claim 1, further comprising a cooling system that surrounds at least a portion of the chamber.

23. The ink ejecting apparatus of claim 22, wherein the cooling system includes a cooling jacket that is defined by a plurality of microchannels that communicate with a source of coolant.

24. The ink ejecting apparatus of claim 1, wherein the liquid mass comprises ink.

25. The ink ejecting apparatus of claim 24, wherein the ink is not a water-based ink.

26. The ink ejecting apparatus of claim 1, where in the source of electromagnetic energy is a laser diode.

27. The ink ejecting apparatus of claim 1, wherein the source of electromagnetic energy is at least one electrode that generates an electrical discharge which vaporizes said portion of the liquid mass.

28. The ink ejecting apparatus of claim 1, wherein the source of electromagnetic energy is arranged so as to asymmetrically expose the liquid mass to electromagnetic energy.

* * * * *

UNITED STATES PATENT AND TRADEMARK OFFICE

CERTIFICATE OF CORRECTION

PATENT NO. : 7,367,653 B2
APPLICATION NO. : 11/341876
DATED : May 6, 2008
INVENTOR(S) : Ran Yaron It is certified that error appears in the above-identified patent and that said Letters Patent is hereby corrected as shown below:

On Title Page of patent, please insert, item [63]:

Related U.S. Application Data

Provisional Application No. 60/355,947, filed on February 11, 2002

Application Serial No. 10/365,722 filed on February 11, 2003 now Patent No. 7,025,442

Signed and Sealed this

Second Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,367,653 B2
APPLICATION NO. : 11/341876
DATED : May 6, 2008
INVENTOR(S) : Ran Yaron It is certified that error appears in the above-identified patent and that said Letters Patent is hereby corrected as shown below:

In Column 15, Line 26, Delete "($f_n$)" and insert -- ($f_n$), --, therefor.

In Column 17, Line 9, Delete "%" and insert -- $\lambda$ --, therefor.

Signed and Sealed this

Third Day of November, 2009

David J. Kappos

David J. Kappos
*Director of the United States Patent and Trademark Office*